US008795796B2

(12) United States Patent
Koenig

(10) Patent No.: US 8,795,796 B2
(45) Date of Patent: Aug. 5, 2014

(54) COATED PRINTABLE SUBSTRATES PROVIDING HIGHER PRINT QUALITY AND RESOLUTION AT LOWER INK USAGE

(75) Inventor: Michael F. Koenig, Paducah, KY (US)

(73) Assignee: International Paper Company, Memphis, TN (US)

( * ) Notice: Subject to any disclaimer, the term of this patent is extended or adjusted under 35 U.S.C. 154(b) by 220 days.

(21) Appl. No.: 13/188,953

(22) Filed: Jul. 22, 2011

(65) Prior Publication Data

US 2012/0019587 A1 Jan. 26, 2012

Related U.S. Application Data

(60) Provisional application No. 61/366,957, filed on Jul. 23, 2010.

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5218* (2013.01); *B41M 5/52* (2013.01); *B41M 5/506* (2013.01); *B41M 5/5254* (2013.01)

USPC ..... 428/32.21; 428/32.28; 428/32.34; 428/32.35; 428/32.37

(58) Field of Classification Search

CPC ..... B41M 5/5218; B41M 5/52; B41M 5/506; B41M 5/5254

USPC ..... 428/32.21, 32.28, 32.34, 32.35, 32.37

See application file for complete search history.

(56) References Cited

U.S. PATENT DOCUMENTS

| | | | |
|---|---|---|---|
| 3,600,385 | A | 8/1971 | Loffelman |
| 3,719,514 | A | 3/1973 | Taylor |
| 3,956,283 | A | 5/1976 | Fleck |

(Continued)

FOREIGN PATENT DOCUMENTS

| | | |
|---|---|---|
| EP | 0652324 | 5/1995 |
| EP | 0747235 | 12/1996 |

(Continued)

OTHER PUBLICATIONS

Grace—Coatings Product Overview—2012.*

(Continued)

*Primary Examiner* — Betelhem Shewareged

(74) *Attorney, Agent, or Firm* — Thomas W. Barnes, III; Eric W. Guttag

(57) ABSTRACT

An article in the form of a paper substrate having a water-swellable substrate coating on at least one of the first and second surfaces at a thickness of less than about 10 microns and. The substrate coating has an amount of a coating pigment sufficient to impart a Parker Print Smoothness value of at least about 4 to the at least one surface and is dispersed in a water-swellable coating pigment binder matrix in a coating pigment to binder matrix weight ratio of at least about 2:1. The coating pigment has larger porous coating pigment particles, and smaller coating pigment particles in a weight ratio of at least about 0.2:1. The substrate coating provides an ink-receptive porous surface. Also, a method for preparing such coated paper substrates, as well as a method for printing an image on the coated paper substrate with an inkjet printer using a lower ink usage level.

41 Claims, 4 Drawing Sheets

(56) References Cited

U.S. PATENT DOCUMENTS

| | | | |
|---|---|---|---|
| 4,371,582 | A | 2/1983 | Sugiyama et al. |
| 4,440,827 | A | 4/1984 | Miyamoto et al. |
| 4,721,655 | A | 1/1988 | Trzasko |
| 4,806,207 | A | 2/1989 | Monzon et al. |
| 5,000,797 | A | 3/1991 | Honkura et al. |
| 5,043,017 | A | 8/1991 | Passaretti |
| 5,164,006 | A | 11/1992 | Chapnerkar et al. |
| 5,254,403 | A | 10/1993 | Malhotra |
| 5,281,467 | A | 1/1994 | Shimada et al. |
| 5,397,619 | A | 3/1995 | Kuroyama et al. |
| 5,429,860 | A | 7/1995 | Held et al. |
| 5,478,388 | A | 12/1995 | Gane et al. |
| 5,531,821 | A | 7/1996 | Wu |
| 5,593,488 | A | 1/1997 | Wu |
| 5,593,489 | A | 1/1997 | Wu |
| 5,599,388 | A | 2/1997 | Wu |
| 5,605,750 | A | 2/1997 | Romano et al. |
| 5,643,631 | A | 7/1997 | Donigian et al. |
| 5,686,602 | A | 11/1997 | Farooq et al. |
| 5,711,799 | A | 1/1998 | Snowden et al. |
| 5,750,086 | A | 5/1998 | You |
| 5,783,038 | A | 7/1998 | Donigian et al. |
| 5,851,651 | A | 12/1998 | Chao |
| 5,858,555 | A | 1/1999 | Kuroyama et al. |
| 5,919,558 | A | 7/1999 | Chao |
| 5,965,244 | A | 10/1999 | Tang et al. |
| 5,985,424 | A | 11/1999 | DeMatte et al. |
| 6,083,317 | A | 7/2000 | Snowden et al. |
| 6,139,961 | A | 10/2000 | Blankenship et al. |
| 6,150,289 | A | 11/2000 | Chen et al. |
| 6,162,328 | A | 12/2000 | Cennisio et al. |
| 6,187,430 | B1 | 2/2001 | Mukoyoshi et al. |
| 6,194,077 | B1 | 2/2001 | Yuan et al. |
| 6,207,258 | B1 | 3/2001 | Varnell |
| 6,242,082 | B1 | 6/2001 | Mukoyoshi et al. |
| 6,623,819 | B2 | 9/2003 | Missell et al. |
| 6,626,531 | B2 | 9/2003 | Fujii et al. |
| 6,656,545 | B1 | 12/2003 | Schliesman et al. |
| 6,666,953 | B1 | 12/2003 | Gane et al. |
| 6,713,550 | B2 | 3/2004 | Schliesman et al. |
| 6,764,726 | B1 | 7/2004 | Yang et al. |
| 6,777,041 | B2 | 8/2004 | Yau et al. |
| 6,783,818 | B2 | 8/2004 | Tsuchiya et al. |
| 6,808,767 | B2 | 10/2004 | Schliesman |
| 6,815,021 | B1 | 11/2004 | Ishikawa et al. |
| 6,818,685 | B1 | 11/2004 | Chapman |
| 6,857,733 | B2 | 2/2005 | Issler |
| 6,979,481 | B2 | 12/2005 | Gaynor et al. |
| 7,018,708 | B2 | 3/2006 | Song et al. |
| 7,056,969 | B2 | 6/2006 | Cuch et al. |
| 7,172,651 | B2 | 2/2007 | Chen et al. |
| 7,255,901 | B2 | 8/2007 | Yamaguchi et al. |
| 7,297,382 | B2 | 11/2007 | Van Aert et al. |
| 7,303,794 | B2 | 12/2007 | Superka et al. |
| 7,521,101 | B2 | 4/2009 | Naisby et al. |
| 7,559,642 | B2 | 7/2009 | Shigemura |
| 7,582,188 | B2 | 9/2009 | Stoffel et al. |
| 7,618,692 | B2 | 11/2009 | Nakano et al. |
| 7,638,017 | B2 | 12/2009 | Gane et al. |
| 7,638,176 | B2 | 12/2009 | Kasperchik et al. |
| 7,651,216 | B2 | 1/2010 | Chen et al. |
| 7,651,747 | B2 | 1/2010 | Chen et al. |
| 7,655,287 | B2 | 2/2010 | Yoshida et al. |
| 7,658,981 | B2 | 2/2010 | Teramae |
| 8,012,551 | B2 | 9/2011 | Song et al. |
| 8,123,907 | B2 | 2/2012 | Stoffel et al. |
| 8,586,156 | B2 * | 11/2013 | Koenig et al. ..... 428/32.21 |
| 2003/0227531 | A1 | 12/2003 | Hosoi |
| 2004/0032473 | A1 | 2/2004 | Ishimoto et al. |
| 2004/0033323 | A1 | 2/2004 | Gaynor et al. |
| 2004/0038056 | A1 | 2/2004 | Song et al. |
| 2004/0197496 | A1 | 10/2004 | Song et al. |
| 2005/0041084 | A1 | 2/2005 | Mukherjee et al. |
| 2005/0100688 | A1 | 5/2005 | Nakano et al. |
| 2005/0124755 | A1 | 6/2005 | Mitchell |
| 2005/0146589 | A1 | 7/2005 | Gibbison et al. |
| 2005/0260428 | A1 | 11/2005 | Song et al. |
| 2006/0003117 | A1 | 1/2006 | Superka et al. |
| 2006/0051528 | A1 | 3/2006 | Ogino |
| 2006/0060317 | A1 | 3/2006 | Roding et al. |
| 2006/0062942 | A1 | 3/2006 | Gaynor et al. |
| 2006/0115612 | A1 | 6/2006 | Nakata et al. |
| 2006/0137574 | A1 | 6/2006 | Preston et al. |
| 2006/0159910 | A1 | 7/2006 | Song et al. |
| 2006/0204688 | A1 | 9/2006 | Ushiku |
| 2006/0254738 | A1 | 11/2006 | Anderson |
| 2007/0014941 | A1 | 1/2007 | Chen et al. |
| 2007/0076075 | A1 | 4/2007 | Schmid et al. |
| 2007/0087138 | A1 | 4/2007 | Koenig et al. |
| 2007/0125267 | A1 | 6/2007 | Song et al. |
| 2007/0218222 | A1 | 9/2007 | Campbell et al. |
| 2007/0235119 | A1 | 10/2007 | McManus et al. |
| 2008/0020152 | A1 | 1/2008 | Watanabe et al. |
| 2008/0075869 | A1 | 3/2008 | Nelli |
| 2008/0098931 | A1 | 5/2008 | Skaggs et al. |
| 2008/0187691 | A1 | 8/2008 | Osgood et al. |
| 2009/0035478 | A1 | 2/2009 | Zhou et al. |
| 2009/0122127 | A1 | 5/2009 | Baker |
| 2009/0274855 | A1 | 11/2009 | Koenig et al. |
| 2009/0295892 | A1 | 12/2009 | Akiyama |
| 2009/0297738 | A1 | 12/2009 | Song et al. |
| 2009/0320708 | A1 | 12/2009 | Jackson et al. |
| 2010/0028659 | A1 | 2/2010 | Shinomo et al. |
| 2010/0129553 | A1 | 5/2010 | Jackson et al. |
| 2011/0151148 | A1 | 6/2011 | Koenig et al. |
| 2011/0151149 | A1 | 6/2011 | Koenig |
| 2011/0240241 | A1 | 10/2011 | Koenig et al. |
| 2011/0240242 | A1 | 10/2011 | Koenig et al. |
| 2011/0274856 | A1 * | 11/2011 | Koenig et al. ..... 428/32.21 |
| 2012/0019587 | A1 | 1/2012 | Koenig |
| 2012/0121872 | A1 | 5/2012 | Koenig |

FOREIGN PATENT DOCUMENTS

| | | |
|---|---|---|
| EP | 0758696 | 2/1997 |
| EP | 1036666 | 9/2000 |
| EP | 1079356 | 2/2001 |
| EP | 1122085 | 8/2001 |
| EP | 1355004 | 10/2003 |
| EP | 1566281 | 8/2005 |
| EP | 1571149 | 9/2005 |
| EP | 1712597 | 10/2006 |
| EP | 1712677 | 10/2006 |
| EP | 1743976 | 1/2007 |
| EP | 1775141 | 4/2007 |
| EP | 1947240 | 7/2008 |
| JP | 2002274012 | 9/2002 |
| JP | 2004255593 | 6/2004 |
| JP | 2006168017 | 6/2006 |
| WO | 9528285 | 10/1995 |
| WO | 9609345 | 3/1996 |
| WO | 9805512 | 2/1998 |
| WO | 9852765 | 11/1998 |
| WO | 9906219 | 2/1999 |
| WO | 9916973 | 4/1999 |
| WO | 0032407 | 6/2000 |
| WO | 03044275 | 5/2003 |
| WO | 2004030917 | 4/2004 |
| WO | 2005115763 | 12/2005 |
| WO | 2006049545 | 5/2006 |
| WO | 2006050850 | 5/2006 |
| WO | 2006110751 | 10/2006 |
| WO | 2007053681 | 5/2007 |
| WO | 2007141271 | 12/2007 |
| WO | 2008055858 | 5/2008 |
| WO | 2008124731 | 10/2008 |
| WO | 2009110910 | 9/2009 |
| WO | 2009124075 | 10/2009 |
| WO | 2009146416 | 12/2009 |

OTHER PUBLICATIONS

G. A. Smook, Handbook for Pulp and Paper , 2nd Edition, 1992, pp. 289-292 and pp. 283-285.

(56) References Cited

OTHER PUBLICATIONS

High Solids Modified Calcium Carbonates A Concept for Inkjet Papers, Varney Kukkamo, May 2010.
Quantitative Determination of Alkyl Ketene dimer AKD retention in Paper made on a Pilot Paper Machine, p. 253-260.
Paper and board—Determination of sizing—Stoeckigt method, JIS p. 8122: 2004, rev. Mar. 20, 2004, published by Japanese Standards Association.
Chemistry and Application of Rosin Size, E. Strazdins, pp. 1-31.
Pigment Coating Techniques, Chapter 24, p. 415-417, Jukka Linnonmaa and Michael Trefz.
BeMiller et al., Starch, Ullmann's Encyclopedia of Industrial Chemistry, vol. 34, pp. 113-117. online, John Wiley and Sons, Inc. 2011, retrieved on May 16, 2012, Retrieved from Internet: http, onlinelibrary.wiley.com-doi-10.1002-14356007.a25_001.pub4, full.
Quantitative Determination of Alkyl Ketene dimer AKD retention in Paper made on a Pilot Paper Machine, p. 253-260, (2002).
Automataic Color recognition System for Stockigt Sizing Test II Journal of Korea TAPPI, 371-73-81, 2005.
C. E. Farley; R. B. Wasser. The Sizing of Paper. TAPPI Press, 1989, 51-62.
Paper and board—Determination of sizing—Stoeckigt method, JIS P 8122: 2004, rev. Mar. 20, 2004, published by Japanese Standards Association.
Use of T530 HST on calcium carbonate-containing papers, Stever R. Boone, 1996, Tappi Journal, pp. 122-124.
Tracing Tecnique in Geohydrology by Werner Kass and Horst Behrens, published by Taylor and Francis, 1998, pp. 48-55.
Sythetic Detergents in the Soap Industry Lime Soap Dispersion Test, H.C. Borghetty et al., J. Am. Oil, Chem. Soc., 27-88-90 1950.
Lipids in Cereal Staraches—A Review; William R. Morrison; Jounal of Cereal Science 8 1988, pp. 1-15.

* cited by examiner

COATED PRINTABLE SUBSTRATES PROVIDING HIGHER PRINT QUALITY AND RESOLUTION AT LOWER INK USAGE

FIELD OF THE INVENTION

The present invention broadly relates to printable substrates comprising paper substrates having a coating on one or both surfaces of the paper substrate for higher print quality, good print resolution, fast drying, etc., at lower usage levels of inkjet ink. The present invention further broadly relates to a method for preparing such coated paper substrates, as well as a method for printing an image on the coated paper substrate with an inkjet printer using a lower ink usage level.

BACKGROUND

In conventional calendered papermaking for providing papers used in printing, a fibrous web may be prepared from an aqueous solids mixture which may comprise wood pulp and/or synthetic fibers along with various additives such as sizing agents, binders, fillers, pigments, etc. Sizing agents are used primarily to prevent excess penetration, wicking, spreading, resistance to blotting etc., of water or ink, and especially internal absorption of the water or ink by the resulting paper substrate. Such sizing agents may include "internal sizing" agents in which the sizing agent (e.g., an alkyl ketene dimer, an alkenyl succinic anhydride, etc.) is included, added, etc., during the papermaking process before a fibrous paper substrate is formed, as well as "surface sizing" agents (e.g., starch, styrene maleic anhydride copolymers, styrene acrylates, etc.) in which the sizing agent is applied on, added to, etc., the surface of formed fibrous paper substrate. The sized paper substrate may exhibit improved properties in terms of, for example, print density, because more of the dye or pigment present in the ink remains on the surface of the paper substrate, rather than being absorbed internally by the paper substrate.

In recent years, the use of ink-jet printing methods has been increasing at a rapid rate. Inkjet printing is a method for forming ink images on a paper substrate from deposited droplets of ink comprising dyes or pigments. This printing method enables high-speed and full-color printing to be achieved. In inkjet printing, the fine droplets of ink are sprayed or jetted from printing nozzles at a high speed so as to direct the ink droplets toward, and deposit these droplets on, the paper substrate to provide printed images on the paper substrate.

The ink used in inkjet printing may contain either dyes or pigments as print agents. In the case of inks comprising pigments, the ink may also be in the form of a pigment emulsion. The use of pigment emulsions in the ink may increase the dry time for the ink droplets deposited on the surface of the paper substrate, and may thus lead to, for example, smearing of the deposited ink droplets. Ink dry time may particularly increase when the ink droplets are deposited onto the surface of a paper substrate which has been treated with an internal and/or surface sizing agent.

SUMMARY

According to a first broad aspect of the present invention, there is provided an article comprising:

- a paper substrate having a first surface and a second surface, wherein the paper substrate has an HST value of up to about 50 seconds; and
- a water-swellable substrate coating on at least one of the first and second surfaces which has a thickness of less than about 10 microns and provides an ink-receptive porous surface, wherein the substrate coating comprises:
  - a water-swellable coating pigment binder matrix, wherein the binder matrix comprises a water-soluble polymer binder and a polymer latex binder in a weight ratio of at least about 1:1 and which have been crosslinked; and
  - an amount of a coating pigment sufficient to impart a Parker Print Smoothness value of at least about 4 to the at least one of the first and second surfaces which is dispersed in the binder matrix in a weight ratio of coating pigment to binder matrix of at least about 2:1, and wherein the coating pigment comprises:—
    - larger porous coating pigment particles having a particle size above about 1 micron and an effective pore volume of at least about 0.1 cc/gm; and
    - smaller coating pigment particles having a particle size of about 1 micron or less;
    - wherein the larger porous coating pigment particles to smaller coating pigment particles are in a weight ratio of least about 0.2:1.

According to a second broad aspect of the present invention, there is provided a method comprising the following steps:

(a) providing a paper substrate having a first surface and a second surface, wherein the paper substrate has an HST value of up to about 50 seconds; and (b) treating at least one of the first and second surfaces with a water-swellable substrate coating to provide a printable substrate, wherein the substrate coating has a thickness of less than about 10 microns and provides an ink-receptive porous surface, and wherein the substrate coating comprises:
- a water-swellable coating pigment binder matrix, wherein the binder matrix comprises a water-soluble polymer binder and a polymer latex binder in a weight ratio of at least about 1:1 and which have been crosslinked; and
- an amount of a coating pigment sufficient to impart a Parker Print Smoothness value of at least about 4 to the at least one of the first and second surfaces, wherein the coating pigment is dispersed in the binder matrix in a coating pigment to binder matrix weight ratio of at least about 2:1, and wherein the coating pigment comprises:
  - larger porous coating pigment particles having a particle size above about 1 micron and an effective pore volume of at least about 0.1 cc/gm; and
  - smaller coating pigment particles having a particle size of about 1 micron or less;
  - wherein the larger porous coating pigment particles to smaller coating pigment particles are in a weight ratio of at least about 0.2:1.

According to a third broad aspect of the present invention, there is provided a method comprising the following steps:

(a) providing a printable substrate comprising:
- a paper substrate having a first surface and a second surface, wherein the paper substrate has an HST value of up to about 50 seconds; and
- a water-swellable substrate coating on at least one of the first and second surfaces which has a thickness of less than 10 microns and provides an ink-receptive porous surface, wherein the substrate coating comprises:
  - a water-swellable coating pigment binder matrix, wherein the binder matrix comprises a water-soluble polymer binder and a polymer latex binder in a weight ratio of at least about 1:1 and which have been crosslinked; and an amount of a coating pigment sufficient to impart a Parker Print Smoothness value of at least about 4 to the at least one of the first and second surfaces, wherein the coating pigment is dispersed in the binder matrix in a coating pigment to binder matrix weight ratio of at least about 2:1, wherein the coating pigment comprises:

larger porous coating pigment particles having a particle size above about 1 micron and an effective pore volume of at least about 0.1 cc/gm; and smaller coating pigment particles having a particle size of about 1 micron or less;

wherein the larger porous coating pigment particles to smaller coating pigment particles are in a weight ratio of at least about 0.2:1; and (b) printing an image on the at least one of the first and second surfaces with an inkjet printer at an ink usage level of up to about 7 gsm.

BRIEF DESCRIPTION OF THE DRAWINGS

The invention will be described in conjunction with the accompanying drawings, in which.

DETAILED DESCRIPTION

Figure 1:
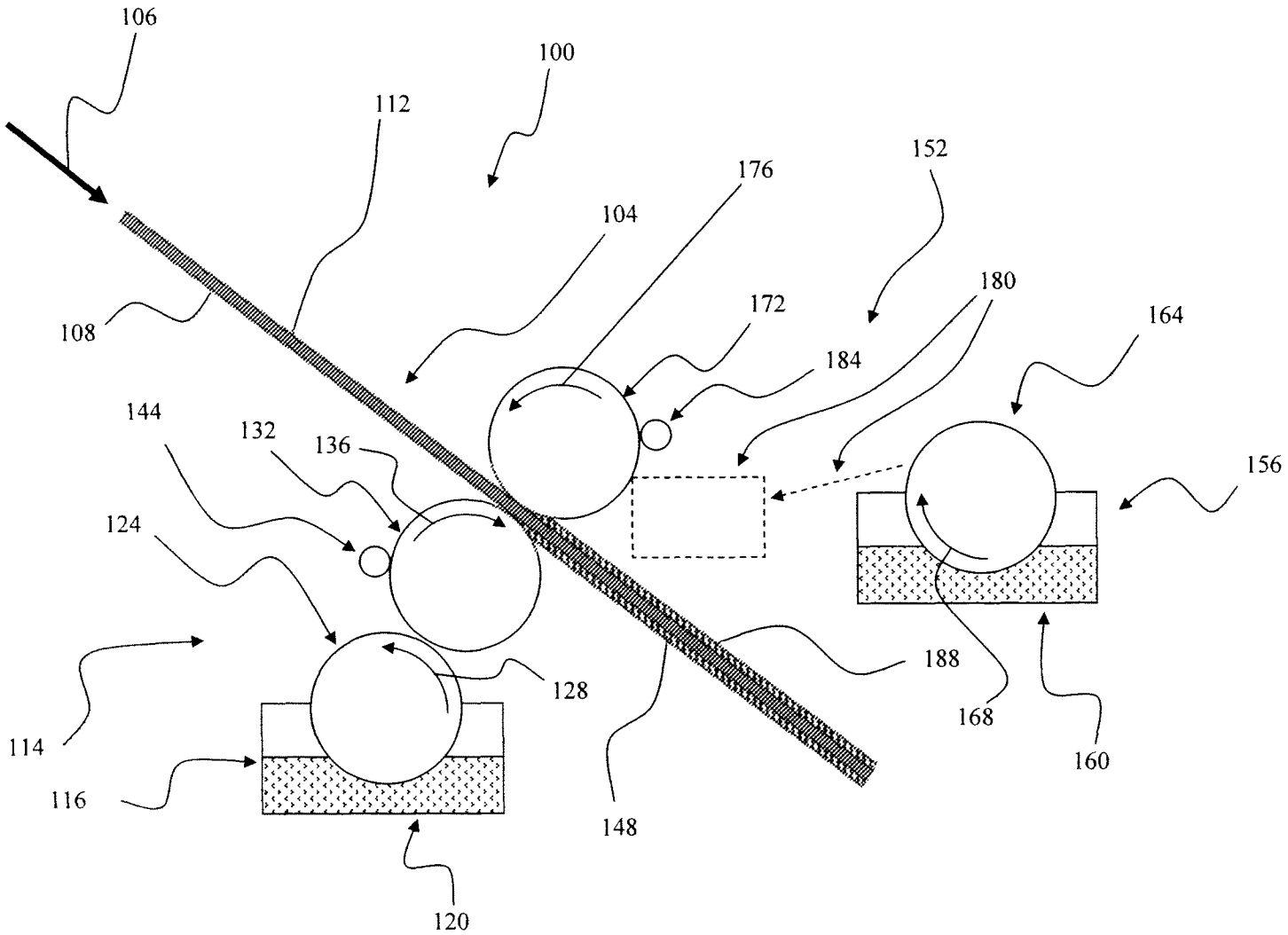
FIG. 1 a schematic diagram illustrating an embodiment of a method for treating one or both surfaces of a paper substrate with a coating composition using a metering rod size press.

It is advantageous to define several terms before describing the invention. It should be appreciated that the following definitions are used throughout this application.

DEFINITIONS

Where the definition of terms departs from the commonly used meaning of the term, applicant intends to utilize the definitions provided below, unless specifically indicated.

For the purposes of the present invention, directional terms such as "top", "bottom", "side," "front," "frontal," "forward," "rear," "rearward," "back," "trailing," "above", "below", "left", "right", "horizontal", "vertical", "upward", "downward", etc. are merely used for convenience in describing the various embodiments of the present invention. The embodiments of the present invention illustrated in, for example, FIGS. 1-3, may be oriented in various ways.

For the purposes of the present invention, the term "printable substrate" refers to any paper substrate which may be printed on with an inkjet printing process. Printable substrates may include webs, sheets, strips, etc., may be in the form of a continuous roll, a discrete sheet, etc.

For the purposes of the present invention, the term "paper substrate" refers to a fibrous web that may be formed, created, produced, etc., from a mixture, furnish, etc., comprising paper fibers, internal paper sizing agents, etc., plus any other optional papermaking additives such as, for example, fillers, wet-strength agents, optical brightening agents (or fluorescent whitening agent), etc. The paper substrate may be in the form of a continuous roll, a discrete sheet, etc.

For the purposes of the present invention, the term "paper filler" refers commonly to mineral products (e.g., calcium carbonate, kaolin clay, etc.) which may be used in paper making to reduce materials cost per unit mass of the paper, increase opacity, increase smoothness, etc. These mineral products may be finely divided, for example, the size range of from about 0.5 to about 5 microns.

For the purposes of the present invention, the term "uncoated paper substrate" refers to a paper substrate which has 0 or substantially 0 paper surface loading of a coating present on one or both sides or surfaces of the paper substrate.

For the purposes of the present invention, the term "single-side coated paper substrate" refers to a paper substrate which has a surface loading of a coating present on one, but not both, sides or surfaces of the paper substrate.

For the purposes of the present invention, the term "double-side coated paper substrate" refers to a paper substrate which has a surface loading of a coating present on both sides or surfaces of the paper substrate.

For the purposes of the present invention, the term "calendered paper" refers to a paper substrate which has been subjected to calendering to, for example, smooth out the paper for enabling printing and writing on the paper, and to increase the gloss on the paper surface. For example, calendering may involve a process of using pressure for embossing a smooth surface on the still rough paper surface. Calendering of paper may be carried out on a calender which may comprise a series of rolls at the end of a papermaking machine (on-line), or separate from the papermaking machine (off-line).

For the purposes of the present invention, the term "coating" refers to those coatings, which comprise, at minimum, a water-swellable crosslinked polymer coating pigment binder, and coating pigment. These coatings (or compositions used to provide such coatings) may also include other optional additives, such as, for example, a metal salt drying agents, cationic dye fixing agents, optical brightening agents, fluorescent whitening agents, solvents, diluents, anti-scratch and mar resistance agents, defoamers, rheology modifiers, dispersants, surfactants, paper sizing agents, etc. The coating compositions may be formulated as an aqueous solution, an aqueous slurry, a colloidal suspension, a liquid mixture, a thixotropic mixture, etc.

For the purposes of the present invention, the term "solids basis" refers to the weight percentage of each of the respective solid materials (e.g., a metal salt drying agent; calcium carbonate pigment component; a cationic dye fixing agent; plastic pigment, surface paper sizing agent, optical brightening agent, etc.) present in the coating, coating composition, etc., in the absence of any liquids (e.g., water). Unless otherwise specified, all percentages given herein for the solid materials are on a solids basis.

For the purposes of the present invention, the term "solids content" refers to the percentage of non-volatile, non-liquid components (by weight) that are present in the coating, composition, etc.

For the purposes of the present invention, the term "water-swellable" refers to a coating, binder, etc., which is able to absorb, imbibe, take up, etc., aqueous fluids, including inkjet inks, but which is not water-soluble, e.g., does not dissolve appreciable in the presence of such aqueous fluids.

For the purposes of the present invention, the term "coating pigment" refers to a material (e.g., a finely divided particulate matter) which may be used or may be intended to be used to affect the ink absorptive properties of a printable substrate.

For the purposes of the present invention, the term "larger porous coating pigment particles" refers to coating pigment particles having particles with a mean particle size above about 1 micron in diameter and an effective pore volume of at least about 0.1 cc/gm, such as at least about 0.2 cc/gm (for example, at least about 0.3 cc/gm). Sources of suitable larger porous coating pigment particles may include one or more of: ground calcium carbonate (GCC) pigment particles, such as cationic ground calcium carbonate (GCC) pigment particles having a surface area of about 43 $m^2/g$ and an effective pore volume of at least about 0.2 cc/gm (such as those available as Omyajet), precipitated calcium carbonate particles, absorptive plastic pigment particles, clay pigment particles, kaolin pigment particles, calcined clay pigment particles, talc pigment particles, titanium dioxide pigment particles, barium sulfate pigment particles, silica pigment particles, zeolite pigment particles, etc.

For the purposes of the present invention, the term "effective pore volume" refers to the internal pore volume due to: (a) voids or hollow spaces which extend beneath the pigment surface, (b) pores or pits on the pigment surface, and/or (c) cracks or fissures in the pigment surface due to the fracture of larger particles or the fusing of smaller particles. The effective pore volume may be calculated by the following equation: EPV=(1/D(pigment))−(1/D(solid pigment)), wherein EPV is the effective pore volume, D(pigment) is the measured or calculated density of the pigment in question, and D(solid pigment) is the density of a solid pigment particle made of the same material but without any internal pore volume.

For the purposes of the present invention, the term "smaller coating pigment particles" refers to coating pigment particles having particles with a mean particle size of about 1 micron or less in diameter. Sources of suitable smaller coating pigment particles may include one or more of: fumed silica pigment particles, such as anionic fumed silica (e.g., Degussa Aerodisp W7330N), alumina pigment particles, ground calcium carbonate pigment particles, precipitated calcium carbonate pigment particles, clay pigment particles, kaolin pigment particles, calcined clay pigment particles, bentonite clay pigment particles, talc pigment particles, titanium dioxide pigment particles, barium sulfate pigment particles, silica pigment particles, etc.

For the purposes of the present invention, the term "calcium carbonate" refers various calcium carbonates which may be used as coating pigments, such as precipitated calcium carbonate (PCC), ground calcium carbonate (GCC), modified PCC and/or GCC, etc.

For the purposes of the present invention, the term "precipitated calcium carbonate (PCC)" refers to a calcium carbonate which may be manufactured by a precipitation reaction and which may used as a coating pigment. PCC may comprise almost entirely of the calcite crystal form of $CaCO_3$. The calcite crystal may have several different macroscopic shapes depending on the conditions of production. Precipitated calcium carbonates may be prepared by the carbonation, with carbon dioxide ($CO_2$) gas, of an aqueous slurry of calcium hydroxide ("milk of lime"). The starting material for obtaining PCC may comprise limestone, but may also be calcined (i.e., heated to drive off $CO_2$), thus producing burnt lime, CaO. Water may added to "slake" the lime, with the resulting "milk of lime," a suspension of $Ca(OH)_2$, being then exposed to bubbles of $CO_2$ gas. Cool temperatures during addition of the $CO_2$ tend to produce rhombohedral (blocky) PCC particles. Warmer temperatures during addition of the $CO_2$ tend to produce scalenohedral (rosette-shaped) PCC particles. In either case, the end the reaction occurs at an optimum pH where the milk of lime has been effectively converted to $CaCO_3$, and before the concentration of $CO_2$ becomes high enough to acidify the suspension and cause some of it to redissolve. In cases where the PCC is not continuously agitated or stored for many days, it may be necessary to add more than a trace of such anionic dispersants as polyphosphates. Wet PCC may have a weak cationic colloidal charge. By contrast, dried PCC may be similar to most ground $CaCO_3$ products in having a negative charge, depending on whether dispersants have been used. The calcium carbonate may be precipitated from an aqueous solution in three different crystal forms: the vaterite form which is thermodynamically unstable, the calcite form which is the most stable and the most abundant in nature, and the aragonite form which is metastable under normal ambient conditions of temperature and pressure, but which may convert to calcite at elevated temperatures. The aragonite form has an orthorhombic shape that crystallizes as long, thin needles that may be either aggregated or unaggregated. The calcite form may exist in several different shapes of which the most commonly found are the rhombohedral shape having crystals that may be either aggregated or unaggregated and the scalenohedral shape having crystals that are generally unaggregated. Sources of suitable PCC may include, for example, those describe in U.S. Pat. No. 6,666,953 (Gane et al.), issued Dec. 24, 1999, U.S. Pat. No. 7,638,017 (Gane et al.), issued Dec. 29, 2009, and European Pat. Appln. No. 1,712,595 (Kaessberger), published Oct. 18, 2006, the entire contents and disclosures of which are herein incorporated by reference.

For the purposes of the present invention, the term "absorptive plastic pigment" (also known as "hollow sphere plastic pigments") refers to a coating pigment comprising a polymeric outer shell enclosing or encapsulating an inner void, space, cavity, etc. Sources of suitable absorptive plastic pigments are disclosed in, for example, U.S. Pat. No. 4,806,207 (Monzon et al.), issued Feb. 21, 1989; and U.S. Pat. No. 6,139,961 (Blankenship et al.), issued Oct. 31, 2000, the entire contents and disclosures of which are herein incorporated by reference.

For the purposes of the present invention, the term "fumed silica" refers to a non-crystalline silica which may be made by flame pyrolysis of silicon tetrachloride, from quartz sand vaporized in a 3000° C. electric arc, etc. Fumed silica may have a primary particle size of from about 5 to about 50 nm. The fumed silica primary particles are non-porous, with the agglomerated secondary particles formed in solution generally having a surface area of 50-600 m2/g. Sources of suitable fumed silica may be obtained from Evonik Degussa, Cabot, and Wacker Chemie-Dow Corning.

For the purposes of the present invention, the term "water-swellable coating pigment binder matrix" refers to a water-swellable binder matrix for paper substrate coatings which may be used to improve the coating pigment binding strength of the coating composition, coating, etc. Coating pigment binder matrices useful herein comprise a water-soluble polymer binder and a polymer latex binder which have been crosslinked so that the binder matrix is water-swellable, but not water-soluble.

For the purposes of the present invention, the term "water-soluble polymer binder" refers to a binding agent for substrate pigments which may comprise linear, branched, or graft polymers or copolymers which contain sufficient hydrophilic segments to render the polymer water-soluble. Sources of suitable water-soluble polymer binders may include one or more of: starch binders, cellulosic binders (such as Methocel K, a cellulosic ether from Dow Chemical), polyvinyl alcohol binders (such as Elvanol 70-06, a fully hydrolyzed polyvinyl alcohol from DuPont), polyacrylic acid binders, polymethacrylic acid binders, polyvinylamine binders, polyacrylamide binders, polyether binders, sulfonated polystyrene binders, carboxylated polystyrene binders, etc.

For the purposes of the present invention, the term "starch binder" refers to a water-soluble polymer binder agent for coating pigments which comprises one or more of: starch, a starch derivative, etc. Suitable starch binders may be derived from a natural starch, e.g., natural starch obtained from a known plant source, for example, wheat, maize, potato, tapioca, etc. The starch binder may be modified (i.e., a modified starch) by one or more chemical treatments known in the paper starch binder art, for example, by oxidation to convert some of —$CH._2OH$ groups to —COOH groups, etc. In some cases the starch binder may have a small proportion of acetyl groups. Alternatively, the starch binder may be chemically treated to render it cationic (i.e., a cationic starch) or amphoteric (i.e., an amphoteric starch), i.e., with both cationic and anionic charges. The starch binder may also be a starch converted to a starch ether, or a hydroxyalkylated starch by replacing some —OH groups with, for example, —$OCH_2CH_2OH$ groups, —$OCH_2CH_3$ groups, —$OCH_2CH_2CH_2OH$ groups, etc. A further class of chemically treated starch binders which may be used are known as the starch phosphates. Alternatively, raw starch may be hydrolyzed by means of a dilute acid, an enzyme, etc., to produce a starch binder in the form of a gum of the dextrin type.

For the purposes of the present invention, the term "polymer latex binder" refers to a binder agent for coating pigments which comprises polymer emulsions, polymer suspensions, etc. Sources of suitable polymer latex binders may include one or more of: styrene butadiene rubber latexes (such as CP620NA from Dow Chemical), acrylic polymer latexes, polyvinyl acetate latexes, styrene acrylic copolymer latexes (such as CP6810NA from Dow Chemical), polyurethane latexes, starch/acrylic copolymer latexes, starch/styrene acrylic copolymer latexes (such as PenSize and PenCP starch/latex copolymers from Penford Products), polyvinyl alcohol (PVOH)/styrene acrylic copolymer latexes, PVOH/acrylic copolymer latexes, etc.

For the purposes of the present invention, the term "crosslinked" refers to a binder matrix which is chemically and/or physically crosslinked to be water-swellable, but water-insoluble.

For the purposes of the present invention, the term "physically crosslinked" refers to a binder matrix which is effectively crosslinked because of the structure of the polymer matrix (e.g., the presence of crystalline segments of the polymer chain, higher Tg segments of the polymer chain, hydrophobic segments of the polymer chain which are not water-soluble, etc.), and not because of chemical crosslinking. Suitable physically crosslinked binders may include high molecular weight (entangled) starch polymers or wholly hydrolyzed polyvinyl alcohols (PVOH), which may have crystalline segments of the polymer chain which are not water-soluble at room temperature, or copolymers, such PenCote, PenCP, PenSize, PenStock, etc., which are graft copolymers of starch and styrene-acrylate polymers which contain styrene and/or acrylic side chains which are not water-soluble, as well as combinations or mixtures of such physically crosslinked polymers.

For the purposes of the present invention, the term "chemically crosslinked" refers to a polymer matrix which is crosslinked by the use of chemical crosslinking agents. Suitable chemically crosslinked polymers may include those which may be chemically crosslinked with, for example, glyoxals, borate salts, organic titanate salts, epoxides (such as Heloxy 67 from Hexion), etc. (e.g., effective for those polymers having hydroxy groups such as polyvinyl alcohols, modified starches, hydroxylated acrylic polymers, or hydroxylated styrene-acrylic polymers, cellulosics, etc.), zirconium salts or azirdine (e.g., effective for those polymers having hydroxy and especially carboxy groups, such acrylic latexes, guar gum, carboxymethylcelluloses, styrene-acrylic copolymers, polyurethanes, epoxies, etc.), etc., as well as combinations or mixtures of such physically crosslinked polymers.

For the purpose of the present invention, the term "treating" with reference to the coatings and compositions used to provide such coatings may include adding, depositing, applying, spraying, coating, daubing, spreading, wiping, dabbing, dipping, etc.

For the purposes of the present invention, the term "paper substrate surface coverage" refers to amount of a coating, or composition used to provide such coatings, present on a given side or surface of the paper substrate being treated. Paper substrate surface coverage may be defined in terms of grams of composition per square meter of paper substrate (hereinafter referred to as "gsm").

For the purposes of the present invention, the term "remains predominantly on the surface(s) of the paper substrate" refers to the coating, or composition used to provide such coatings, remaining primarily on the surface of the paper substrate, and not being absorbed by or into the interior of the paper substrate.

For the purposes of the present invention, the term "coater" refers to a device, equipment, machine, etc., which may be used to treat, apply, coat, etc., the coating, or composition used to provide such coatings, to one or more sides or surfaces of a paper substrate, for example, just after the paper substrate has been dried for the first time. Coaters may include air-knife coaters, rod coaters, blade coaters, size presses, etc. See G. A. Smook, Handbook for Pulp and Paper Technologists ($2^{nd}$ Edition, 1992), pages 289-92, the entire contents and disclosure of which is herein incorporated by reference, for a general description of coaters that may be useful herein. Size presses may include a puddle size press, a metering size press, etc. See G. A. Smook, Handbook for Pulp and Paper Technologists ($2^{nd}$ Edition, 1992), pages 283-85, the entire contents and disclosure of which is herein incorporated by reference, for a general description of size presses that may be useful herein.

For the purposes of the present invention, the term "flooded nip size press" refers to a size press having a flooded nip (pond), also referred to as a "puddle size press." Flooded nip size presses may include vertical size presses, horizontal size presses, etc.

For the purposes of the present invention, the term "metering size press" refers to a size press that includes a component for spreading, metering, etc., deposited, applied, etc., the coating, or composition used to provide such coatings, on a paper substrate side or surface. Metering size presses may include a rod metering size press, a gated roll metering size press, a doctor blade metering size press, etc.

For the purposes of the present invention, the term "rod metering size press" refers to metering size press that uses a rod to spread, meter, etc., the coating, or composition used to provide such coatings, on the paper substrate surface. The rod may be stationary or movable relative to the paper substrate.

For the purposes of the present invention, the term "gated roll metering size press" refers to a metering size press that may use a gated roll, transfer roll, soft applicator roll, etc. The gated roll, transfer roll, soft applicator roll, etc., may be stationery relative to the paper substrate, may rotate relative to the paper substrate, etc.

For the purposes of the present invention, the term "doctor blade metering size press" refers to a metering press which may use a doctor blade to spread, meter, etc., the coating, or composition used to provide such coatings, on the paper substrate surface.

For the purposes of the present invention, the term "metal drying salt" refers to those metal salts which may improve the dry time of inks deposited or printed on printable substrates by inkjet printing processes. These metal drying salts comprise one or more multivalent metal drying salts, and may optionally further comprise one or more monovalent metal drying salts. The counter anions for these metal salts may include, for example, chloride, bromide, acetate, bicarbonate, sulfate, sulfite, nitrate, hydroxide, silicate, chlorohydrate, etc. The metal drying salt may be provided as an aqueous solution comprising, for example, from about 1 to about 60% (e.g., from about 10 to about 40%) of the multivalent metal drying salt.

For the purposes of the present invention, the term "multivalent metal drying salt" refers to those metal drying salts wherein the cationic moiety is a multivalent cation having a positive charge of two or more (e.g., a calcium cation, a magnesium cation, an aluminum cation, etc.) such as calcium salts, magnesium salts, aluminum salts, etc., and which are water-soluble. Suitable multivalent metal drying salts (e.g., divalent salts, trivalent salts, etc.) may include one or more of calcium chloride, calcium acetate, calcium hydroxide, calcium nitrate, calcium sulfate, calcium sulfite, magnesium chloride, magnesium acetate, magnesium nitrate, magnesium sulfate, magnesium sulfite, aluminum chloride, aluminum nitrate, aluminum sulfate, aluminum chlorohydrate, sodium aluminum sulfate, vanadium chloride, etc.

For the purposes of the present invention, the term "monovalent metal drying salt" refers to those metal drying salts wherein the cationic moiety is a monovalent cation having a positive charge of one (e.g., a sodium cation, a potassium cation, a lithium cation, etc.) such as sodium salts, potassium salts, lithium salts, etc. Suitable monovalent metal drying salts may include one or more of sodium chloride, sodium acetate, sodium carbonate, sodium bicarbonate, sodium hydroxide, sodium silicates, sodium sulfate, sodium sulfite, sodium nitrate, sodium bromide, potassium chloride, potassium acetate, potassium carbonate, potassium bicarbonate, potassium hydroxide, potassium silicates, potassium sulfate, potassium sulfite, potassium nitrate, potassium bromide, lithium chloride, lithium acetate, lithium carbonate, lithium bicarbonate, lithium hydroxide, lithium silicates, lithium sulfate, lithium sulfite, lithium nitrate, lithium bromide, etc.

For the purposes of the present invention, the term "cationic dye fixing agent" refers to those cationic compounds (e.g., nitrogen-containing compounds) or mixtures of such compounds which may aid in fixing, trapping, etc., inks printed by inkjet printing processes, and which may provide other properties, including water fastness. These cationic dye fixing agents may include compounds, oligomers and polymers which contain one or more quaternary ammonium functional groups, and may include cationic water-soluble polymers that are capable of forming a complex with anionic dyes. Such functional groups may vary widely and may include substituted and unsubstituted amines, imines, amides, urethanes, quaternary ammonium groups, dicyandiamides, guanadines, biguanides, etc. Illustrative of such compounds are polyamines, polyethyleneimines, polymers or copolymers of diallyldimethyl ammonium chloride (DADMAC), copolymers of vinyl pyrrolidone (VP) with quaternized diethylaminoethylmethacrylate (DEAMEMA), polyamides, polyhexamethylene biguanide (PHMB), cationic polyurethane latexes, cationic polyvinyl alcohols, polyalkylamines dicyandiamid copolymers, amine glycidyl addition polymers, poly [oxyethylene (dimethyliminio) ethylene (dimethyliminio) ethylene]dichlorides, etc., or combinations thereof. These cationic dye fixing agents may include low to medium molecular weight cationic polymers and oligomers having a molecular equal to or less than 100,000, for example, equal to or less than about 50,000, e.g., from about 10,000 to about 50,000. Illustrative of such materials are polyalkylamine dicyandiamide copolymers, poly[oxyethylene(dimethyliminio ethylene(dimethyliminioethylene]dichlorides and polyamines having molecular weights within the desired range. Cationic dye fixing agents suitable herein may include low molecular weight cationic polymers such as polyalkylamine dicyandiamid copolymer, poly[oxyethylene(dimethyliminio)ethylene(dimethyliminio)ethylene]dichloride, for example, low molecular weight polyalkylamine dicyandiamid copolymers. See U.S. Pat. No. 6,764,726 (Yang et al.), issued Jul. 20, 2004, the entire disclosure and contents of which is hereby incorporated by reference.

For the purposes of the present invention, the term "opacity" refers to the ability of a paper substrate to hide things such as print images on subsequent sheets or printed on the back, e.g., to minimize, prevent, etc., show-through, etc. As used herein, opacity of the paper substrate may be measured by, for example, in terms of TAPPI opacity and show-through. TAPPI opacity may be measured by T425 om-91.

For the purposes of the present invention, the term "Parker Print Smoothness" refers to the extent to which the paper surface deviates from a planar or substantially planar surface, as affected by the depth of the paper, paper width, numbers of departure from that planar surface, etc., as measured by TAPPI test method T 555 om-99. Parker Print Smoothness values reflect the degree of "microroughness" of the substrate or coating surface. The higher the Parker Print Smoothness value, the rougher the substrate or coating surface. Conversely, the lower Parker Print Smoothness value, the smoother the substrate or coating surface.

For the purposes of the present invention, the term "print quality" refers to those factors, features, characteristics, etc., that may influence, affect, control, etc., the appearance, look, form, etc., of a printed image on the printable substrate. Print quality of a paper substrate may be measured in terms of, for example, one or more of: (1) print density; (2) print contrast; (3) dry times); (4) edge acuity; (5) color gamut; (6) color richness; (7) print gloss; (8) print mottle; and (9) color-to-color bleed. For the purposes of the present invention, print quality of the paper substrate is primarily determined herein by measuring the print density, dry time, and edge acuity of the paper substrate.

For the purposes of the present invention, the term "print density" refers to the optical density ("OD") measured by using a reflectance densitometer (X-Rite, Macbeth. Etc.) which measures the light absorbing property of an image printed on a paper sheet. For example, the higher the print density, the darker the print image may appear. Higher print densities also provide a higher contrast, a sharper image for viewing, etc. Print density is measured herein in terms of the black print density (i.e., the print density of images which are black in color). The method for measuring black print density involves printing a solid block of black color on a paper sheet, and then measuring the optical density. The printer used to print the solid block of black color on the paper sheet is an HP Deskjet 6122, manufactured by Hewlett-Packard, (or its equivalent) which uses a #45 (HP product number 51645A) black inkjet cartridge (or its equivalent). The default setting of Plain Paper type and Fast Normal print quality print mode is used in printing the solid block of black color on the paper sheet. An X-Rite model 528 spectrodensitometer with a 6 mm aperture may be used to measure the optical density of the solid block of black color printed on the paper sheet to provide black print density values. The black print density measurement settings used are Visual color, status T, and absolute density mode. In general, acceptable black print density ("$OD_O$") values for black pigment are at least about 1.45 when using a standard (plain paper, normal) print mode for the HP desktop inkjet printer and when using the most common black pigment ink (equivalent to the #45 inkjet cartridge). Some embodiments of the paper substrates of the present invention may exhibit black print density ($OD_O$) values of at least about 1.50, for example, at least about 1.60. See also commonly assigned U.S. Pat. Appln. No. 2007/0087134 (Koenig et al.), published Apr. 19, 2007, the entire disclosure and contents of which is herein incorporated by reference, which describes how to carry out this black print density test.

For the purposes of the present invention, the term "print contrast" refers to the difference in print density between printed and unprinted areas.

For the purposes of the present invention, the term "dry time" refers to the time it takes for deposited ink to dry on the surface of a printable substrate. If the deposited ink does not dry quickly enough, this deposited ink may transfer to other printable substrate sheets, which is undesirable. The percentage of ink transferred ("IT %") is recorded as a measure of the dry time. The higher the amount of the percentage of ink transferred, the slower (worse) the dry time. Conversely, the lower the amount of the percentage of ink transferred, faster (better) the dry time. Embodiments of the paper substrates of the present invention may provide a percent ink transferred ("IT %") value equal to or less than about 65%. In some embodiments of the paper substrates of the present invention, the IT % value may be equal to or less than about 50%, for example, equal to or less than about 40% (e.g., equal to or less than about 30%.

For the purposes of the present invention, the term "ink transfer" refers to a test for determining the dry time of a printable substrate, for example, printable paper sheets. "Ink transfer" is defined herein as the amount of optical density transferred after rolling with a roller, and is expressed as a percentage of the optical density transferred to the unprinted portion of the printable substrate (e.g., paper sheet) after rolling with a roller. The method involves printing solid colored blocks on paper having a basis weight of 20 lbs/1300 ft.$^2$ (using an HP Deskjet 6122, manufactured by Hewlett-Packard, (or its equivalent) which uses a #45 (HP product number 51645A) black ink jet cartridge (or its equivalent) with the default setting of Plain Paper type and Fast Normal print quality print mode being used), waiting for a fixed amount of time, 5 seconds after printing, and then folding in half so that the printed portion contacts an unprinted portion of the paper sheet, and rolling with a 4.5 lb hand roller as for example roller item number HR-100 from Chem Instruments, Inc., Mentor, Ohio, USA. The optical density is read on the transferred ($OD_T$), the non-transferred ($OD_O$) portions of the block, and an un-imaged area ($OD_B$) by a reflectance densitometer (X-Rite, Macbeth. Etc.). The percent transferred ("IT %") is defined as IT $\%=[(OD_T-OD_B)/(OD_O-OD_B)]\times 100$. See also commonly assigned U.S. Pat. Appln. No. 2007/0087134 (Koenig et al.), published Apr. 19, 2007, the entire disclosure and contents of which is herein incorporated by reference, which describes how to carry out the ink transfer test.

For the purposes of the present invention, the term "edge acuity (EA)" refers to the degree of sharpness (or raggedness) of the edge of a printed image (e.g., a printed line). Edge acuity (EA) may be measured by an instrument such as the QEA Personal Image Analysis System (Quality Engineering Associates, Burlington, Mass.), the QEA ScannerIAS, or the ImageXpert KDY camera-based system. All of these instruments collect a magnified digital image of the sample and calculate an EA value by image analysis. The EA value (also known as "edge raggedness") is defined in ISO method 13660. This method involves printing a solid line 1.27 mm or more in length, and sampling at a resolution of at least 600 dpi. The instrument calculates the location of the edge based on the darkness of each pixel near the line edges. The edge threshold may be defined as the point of 60% transition from the substrate reflectance factor (light area, $R_{max}$) to the image reflectance factor (dark area, $R_{max}$) using the equation $R_{60}=R_{max}-60\%\,(R_{max}-R_{min})$. The edge raggedness may then be defined as the standard deviation of the residuals from a line fitted to the edge threshold of the line, calculated perpendicular to the fitted line. For some embodiments of paper substrates of the present invention, the EA value may be less than about 15, for example, less than about 12, such as less than about 10 (e.g., less than about 8). See also commonly assigned U.S. Pat. Appln. No. 2007/0087134 (Koenig et al.), published Apr. 19, 2007, the entire disclosure and contents of which is herein incorporated by reference, which describes how to measure edge acuity (EA) values.

For the purposes of the present invention, the term "color gamut" refers to the total collection of possible colors in any color reproduction system and may be defined by a complete subset colors. A higher color gamut value indicates a more vivid color print quality. Color gamut may be obtained by measuring the CIE L*, a*, b* of a series of color blocks, including white (unprinted area), cyan, magenta, yellow, red, green, blue and black, and from these measured values, calculating a suitable color gamut. The CIE L* represents the whiteness. The value of L* may range from zero (representing black) to 100 (representing white or a perfectly reflecting diffuser). The value of a* represents the degree of green/red. A positive a* is red, while a negative a* is green. A positive b* is yellow, while a negative b* is blue. The CIE L*, a* and b* values may be measured by X-Rite 528 using a D65 light source and a 10-degree viewing angle.

For the purposes of the present invention, the term "color richness" refers to a more vivid or vibrant color print with high print density and high color gamut values.

For the purposes of the present invention, the term "gloss" refers to the ability of paper to reflect some portion of the incident light at the mirror angle. Gloss may be based on a measurement of the quantity of light specularly reflected from the surface of a paper specimen at a set angle, for example, at 75 degrees, such as in the case of 75 degree gloss (and as measured by TAPPI test method T 480 om-92).

For the purposes of the present invention, the term "print gloss" refers to a gloss measurement made on a printed paper substrate.

For the purposes of the present invention, the term "print mottle" refers to non-uniformity in the print image which may be due to unevenness in ink lay, non-uniform ink absorption, etc., across the printable substrate surface. Print mottle may be measured using a scanner based mottle tester such as the C3PATX03 Formation and Mottle Test with an Agfa Model DUOSCAN scanner. The printable substrate (e.g., paper sheet) sample to be tested is first printed on a test inkjet printer. The test pattern must include a block of solid black (100%) image. The color block is a square of about 20-50 mm by 20-50 mm. After 20 minutes of waiting time, or when the printed image is fully dried, the printed sample is positioned on the scanner with printed face down. The scanner is set at a resolution of 500 ppi (pixel per inch). A Verity software (Verity IA LLC, 2114 Sunrise Drive, Appleton, Wis. 54914) may be used to analyze the test data from the scanner. An appropriate dimension for testing based on the color block dimension is set. Two mottle indices may be measured: Micro Mottle Index and Macro Mottle Index. The Micro Mottle Index measures density variations within an area of 0.1 $in^2$; while the macro mottle index measures the density variations of the averaged density values of each square of 0.1 $in^2$. The lower the mottle index value, the better the print quality.

For the purposes of the present invention, the term "color-to-color bleed" refers to the spreading of one color ink into another color ink on paper which may reduce the resolution of the colored text and lines on a colored background. For example blue and black bars may be printed over a yellow color background. Green and black bars may be printed over magenta color background, and red and black bars may be printed over cyan color background. The smallest distance in microns between two color bars without bridging (or color intruding more than half way to the neighboring color bar) is recorded as the color-to-color bleed index. In other words, the smaller the value of color-to-color bleed, the better the print quality. Distances which may be tested include 50 microns, 100 microns, 150 microns, 300 microns, etc. In some embodiments of the present invention, the tested distance may reach 150 microns or less before bridging (bleed) occurs, which may be considered a "good" color-to-color bleed property.

For the purposes of the present invention, the term "digital printing" refers to reproducing, forming, creating, providing, etc., digital images on a printable substrate, for example, paper, Digital printing may include laser printing, inkjet printing, etc.

For the purposes of the present invention, the term "laser printing" refers to a digital printing technology, method, device, etc., that may use a laser beam to create, form produce, etc., a latent image on, for example, photoconductor drum. The light of laser beam may later create charge on the drum which may then pick up toner which carries an opposite charge. This toner may then be transferred to the paper and the resulting print image created, formed, produced, etc., fused to the printable substrate through, for example, a fuser.

For the purposes of the present invention, the term "electrophotographic recording process" refers to a process which records images on a printable substrate, such as paper, by xerography or electrophotography. In an electrophotographic process, the image is often formed on of the c by toner particles which are deposited one surface or side of the printable substrate, and are then thermally fixed and/or fused to that one surface or side of the printable substrate, for example, by heating. In electrophotographic recording, the printable substrate may have two relatively smooth or flat sides or surfaces, or may have one side or surface which is textured, uneven or nonsmooth/nonflat, while the other side or surface is relatively smooth or flat.

For the purposes of the present invention, the term "inkjet printing" refers to a digital printing technology, method, device, etc., that may form images on a printable substrate, such as a paper substrate, by spraying, jetting, etc., tiny droplets of liquid inks onto the printable substrate through the printer nozzles. The size (e.g., smaller size), precise placement, etc., of the ink droplets may be provide higher quality inkjet prints. Inkjet printing may include continuous inkjet printing, drop-on-demand inkjet printing, etc.

For the purposes of the present invention, the term "liquid" refers to a non-gaseous fluid composition, compound, material, etc., which may be readily flowable at the temperature of use (e.g., room temperature) with little or no tendency to disperse and with a relatively high compressibility.

For the purposes of the present invention, the term "viscosity," with reference to the coating, or composition used to provide such coatings, refers to Brookfield viscosity. The Brookfield viscosity may be measured by a Brookfield viscometer at 150° F., using a #5 spindle at 100 rpm.

For the purpose of the present invention, the term "printer" refers to any device which prints an image on a printable substrate, such as a paper sheet, including laser printers, inkjet printers, electrophotographic recording devices (e.g., copiers), scanners, fax machines, etc.

For the purpose of the present invention, the term "printer colorant" may refer to either ink (as used by, for example, an inkjet printer, etc.) or toner (as used by, for example, a laser printer, electrographic recording device, etc.).

For the purpose of the present invention, the term "ink" refers to printer colorant as used by inkjet printers. The term ink may include dye-based inks and/or pigment-based inks. Dye-based inks comprise a dye which may be an organic molecule which is soluble in the ink medium. Dye-based inks may be classified by their usage, such as acid dyes, basic dyes, or direct dyes, or by their chemical structure, such as azo dyes, which are based on the based on an —N═N— azo structure; diazonium dyes, based on diazonium salts; quinone-imine dyes, which are derivates of quinine, etc. Pigment-based dyes comprise a pigment, which is a solid colored particle suspended in the ink medium. The particle may comprise a colored mineral, a precipitated dye, a precipitated dye which is attached to a carrier particle, etc. Inks are often dispensed, deposited, sprayed, etc., on a printable medium in the form of droplets which then dry on the printable medium to form the print image(s).

For the purpose of the present invention, the term "toner" refers printer colorant as used by laser printers. Toner is often dispensed, deposited, etc., on the printable medium in the form o-f particles, with the particles then being fused on the printable medium to form the image.

For the purposes of the present invention, the term "room temperature" refers to the commonly accepted meaning of room temperature, i.e., an ambient temperature of 20° to 25° C.

For the purpose of the present invention, the term "Hercules Sizing Test" or "HST" refers to a test of resistance to penetration of, for example, an acidic water solution through paper. The HST may be measured using the procedure of TAPPI Standard Method 530 pm-89. See U.S. Pat. No. 6,764,726 (Yang et al.), issued Jul. 20, 2004, the entire disclosure and contents of which is hereby incorporated by reference. The HST value is measured following the conventions described in TAPPI Standard Method number T-530 pm-89, using 1% formic acid ink and 80% reflectance endpoint. The HST value measured reflects the relative level of paper sizing present in and/or on the paper substrate. For example, lower HST values (i.e., HST values below about 50 seconds) reflect a relatively low level of paper sizing present in the paper substrate. Conversely, higher HST values (i.e., HST values above about 250 seconds) reflect a relatively high level of paper sizing present in and/or on the paper substrate. For the purposes of the present invention, an HST value in the range from about 50 to about 250 seconds is considered to be an intermediate HST value reflecting an intermediate level of paper sizing present in and/or on the paper substrate. The HST value measured also reflects both the level of both internal paper sizing, as well as the level of surface paper sizing present. But at the relatively low levels of paper sizing agents normally used in papermaking (e.g., from about 1 to about 2 lbs/ton or from about 0.04 to about 0.08 gsm for paper having a basis weight of 20 lbs/1300 ft.$^2$), the HST value of the paper substrate primarily (if not exclusively) reflects the contribution imparted by the internal paper sizing agents (which generally increase HST values greatly even at low usage levels), rather than surface paper sizing agents (which generally increase HST values minimally at such low usage levels).

For the purpose of the present invention, the term "ink-receptive porous surface" refers to a substrate coating which is able to absorb, imbibe, take up, etc., deposited inkjet ink.

For the purpose of the present invention, the term "coupon" refers to a substrate printed on at least one side with an inkjet printer using pigment-based inks and distributed at the point-of-purchase (e.g., checkout counters) in a retail environment.

For the purpose of the present invention, the term "wet rub resistance" refers to the durability of an ink jet image when subjected to the combination of water exposure and rubbing. A wet rub resistance test may be conducted by using, for example, a highlighter pen, a moistened thumb, a crockmeter (i.e., a device which automatically rubs a material, such as paper, cloth, sandpaper, etc., against a sample, such as test paper, at a certain speed, force, and number of rubs, all of which are programmable by the tester), etc. The ink jet image displaying the least amount of smearing after such testing may be considered to have the best wet rub resistance.

For the purpose of the present invention, the term "ink usage level" refers to the amount of ink (in units of grams per square meter (gsm)) which is printed onto a paper substrate to form an image using an ink jet printer. The particular ink usage level may depend upon the particular printer, the print mode (substrate, print quality, printing speed, etc.), etc., selected.

DESCRIPTION

Embodiments of the articles of the present invention comprising the printable substrates provide the benefit of higher print quality, good print resolution, fast drying, wet rub resistance, etc., at lower usage levels of inkjet pigment. The embodiments of these printable substrates comprise a paper substrate having a first surface and a second surface, wherein the paper substrate has an HST value of up to about 50 seconds, such as up to about 40 seconds; and a water-swellable substrate coating on at least one of the first and second surfaces. The substrate coating comprises: a water-swellable crosslinked polymer coating pigment binder matrix, wherein the binder matrix comprises a water-soluble polymer binder and a polymer latex binder in a weight ratio of at least about 1:1, for example, in the range of from about 1:1 to about 10:1, such as from about 1.5:1 to about 2.5:1 (e.g., about 2:1), and which have been crosslinked; and a coating pigment dispersed in the binder matrix in a weight ratio of at least about 2:1, for example, in the range of from about 2:1 to about 10; 1, such as from about 3:1 to about 5:1. The coating pigment comprises: larger porous coating pigment particles having a mean particle size of above about 1 micron in diameter and an effective pore volume of at least about 0.1 cc/gm, such as at least about 0.2 cc/gm, for example, at least about 0.3 cc/gm (e.g., in the range of from about 0.4 to about 2.2 cc/gm) (the larger porous coating pigment particles may comprise one or more of: ground calcium carbonate pigment particles, precipitated calcium carbonate pigment particles, absorbent plastic pigment particles, clay pigment particles, kaolin pigment particles, calcined clay pigment particles, talc pigment particles, titanium dioxide pigment particles, barium sulfate pigment particles, silica pigment particles, zeolite pigment particles, etc.); and smaller coating pigment particles having a mean particle size of about 1 micron or less in diameter (the smaller coating pigment particles may comprise one or more of: fumed silica pigment particles, alumina pigment particles, ground calcium carbonate pigment particles, precipitated calcium carbonate pigment particles, clay pigment particles, kaolin pigment particles, calcined clay pigment particles, bentonite clay pigment particles, talc pigment particles, titanium dioxide pigment particles, barium sulfate pigment particles, or silica pigment particles, zeolite pigment particles, etc.). The larger porous coating pigment particles to smaller coating pigment particles are in a weight ratio of at least about 0.2:1, for example, in a weight ratio of at least about 1:1, such as at least about 3:1. The substrate coating provides an ink-receptive porous surface and the coating pigment is in an amount sufficient to impart a Parker Print Smoothness value of at least about 4 to the at least one of the first and second surfaces, for example, in the range of from about 4 to about 12, such as from about 4 to about 8.

Embodiments of the present invention also comprise a method for preparing the printable substrate comprising the coated paper substrate. In embodiments of this method, at least one of the first and second surfaces is the paper substrate is treated with the water-swellable substrate coating.

Embodiments of the articles of the present invention comprising the printable substrates may provide coated papers useful in printing coupons on one or both surfaces of the substrate. Accordingly, embodiments of present invention may also comprise a method for printing on a printable substrate, as described above. In embodiments of this printing method, an image is then printed at least one of the first and second surfaces with an inkjet printer at an ink usage level of up to about 7 gsm, for example, in the range of from about 0.5 to about 7 gsm, such as from about 0.5 to about 5 gsm (e.g., from about 0.5 to about 3 gsm. In some embodiments of this printing method, the printable substrate comprises coupon paper, with the image being printed on the coupon paper being in the form of a coupon image.

Coupons for goods or services may be distributed at the point-of-purchase (e.g., checkout counters). These coupons may have information printed on one of the surfaces using, for example, offset or flexographic printers. On the remaining surface, additional information, such as barcodes, may be printed on the coupon at the point of distribution with inkjet printers using pigment based inks. To satisfy the requirements of coupon distributors, paper substrates used with inkjet printers may need to be able to print such coupons with high print quality (e.g., easy to read) and good resolution (e.g., good barcode legibility), utilizing as little ink as possible (i.e., lower ink usage), yet be fast drying and resistant to smearing when wet.

Prior coatings for paper substrates used with inkjet printers may provide high print density and may also be quick drying. Examples of such coated paper substrates include "photo quality" coated papers having a glossy inkjet coating comprised of water-swellable polymers or alumina particles, or a matte inkjet coating comprised of fumed or precipitated silica. These "photo quality" glossy coated papers may provide excellent print density and print resolution, and may be quick drying for desktop photo printers, but exhibit poor smear resistance when printed with pigment-based inkjet inks. The "photo quality" matte coated papers may also have good smear resistance and print quality when printed with desktop photo inkjet printers. But both glossy and matte "photo quality" coated papers may have very low print density when printed with "photo quality" printers because of the very low ink coverage. For example, a coupon printer may provide only about 0.8 gsm of ink, versus, for example, from about 8 to about 10 gsm from a standard desktop ink printer. Such low ink coverage may cause low dot spread, which provides good print resolution, but lower print density.

The problems of using these "photo quality" coated papers for printing coupons with inkjet printers may be solved by embodiments of the printable substrates of the present invention. These printable substrate comprise coated paper substrates which may be used to print, for example, coupons with inkjet coupon printers at relatively lower ink usage levels (e.g., at levels up to about 7 gsm), yet provide higher print quality and good print resolution (e.g., for barcodes), relatively fast dry times, resistance to smearing, etc. Fast dry times may be achieved by using a paper substrate which has reduced internal/surface sizing, i.e., lower HST value of up to about 50 seconds. Higher print density and good print resolution may be achieved by adjusting the absorptivity of the paper substrate coating to match the amount of ink deposited on the paper substrate surface. In this regard, a relatively low coating thickness (i.e., less than about 10 microns) may be used, with the coating pigment to binder matrix weight ratio being adjusted to be higher (i.e., at least about 2:1, for example, in the range of from about 2:1 to about 10:1), and choosing coating pigments that provide appropriate pore volume to hold the ink out in the coating, but also allowing the ink droplet to spread on the coating surface slightly to maximize print density without sacrificing print resolution.

In addition, wet rub resistance of the coated paper is achieved by using: (a) a water-swellable crosslinked polymer coating pigment binder matrix comprising one or more water-soluble polymer binders and one or more polymer latex binders in a weight ratio of at least about 1:1 (e.g., an ethylated starch binder and a styrene-acrylic latex binder in about a 2:1 weight ratio crosslinked with glyoxal) to make the coating water resistant; and (b) creating microroughness in the substrate coating by choosing a coating pigment which comprises larger porous coating pigment particles above about 1 micron in size (e.g., about 4 microns in size average). To achieve both appropriate substrate coating absorptivity and wet rub resistance, a coating pigment comprising: larger porous coating pigment particles having an effective pore volume of at least about 0.2 cc/gm (i.e., a higher porosity) such as a cationic ground calcium carbonate (GCC) having pore volume of at least about 0.3 cc/gm (e.g., such as those available as Omyajet) or an absorptive plastic pigment to provide porosity and smaller coating pigment particles (i.e., low porosity) which may be an (such as Degussa Aerodisp W7330N) to provide water fastness in weight ratio of larger to smaller coating pigment particles of, for example, about 80:20 (i.e., about 4:1).

In some embodiments of these printable substrates: (a) relatively low amounts of internal and/or surface paper sizing may be used with the paper substrate to provide an HST value in the range of from 0 to about 50 seconds; (b) the substrate coating thickness may be in the range of from about 3 to about 8 microns (e.g., if below about 3 microns, it may be more difficult to provide a uniform substrate coating without pinholes); (c) a coating pigment to binder matrix weight ratio of at least about 2:1, for example, in the range from about 2:1 to about 10:1, with the more porous larger coating pigments using a higher binder ratio; (d) a coating pigment blend comprising cationic GCC from Omya (such as those available as Omyajet) having average diameter of about 4-5 microns and a specific surface area of about 43 $m^2/g$, thus giving this pigment an effective pore volume of about 0.2 cc/gm (versus typical anionic GCC having particle size of from about 0.6 to about 1.0 microns in diameter and no pore volume) to provide better (faster) dry time performance, and anionic fumed silica from Degussa (Aerodisp W7330N), in at weight ratio of about 80:20 (i.e., about 4:1); (e) ethylated corn starch and a polymer latex in at least about a 2:1 weight ratio in the binder matrix; and (f) substrate coating crosslinked using glyoxal-based crosslinker to make the coating water resistant, with fumed silica also improving water resistance.

An embodiment of a method of the present invention for treating one or both surfaces of the paper substrate with a coating composition comprising one or more water-swellable coating pigment binders and one or more coating pigments is further illustrated in FIG. 1. Referring to FIG. 1, an embodiment of a system for carrying out an embodiment of the method of the present invention is illustrated which may be in the form of, for example a rod metering size press indicated generally as 100. Size press 100 may be used to coat a paper substrate, indicated generally as 104. Substrate 104 moves in the direction indicated by arrow 106, and which has a pair of opposed sides or surfaces, indicated, respectively, as 108 and 112.

Size press 100 includes a first assembly, indicated generally as 114, for applying the coating composition to surface 108. Assembly 114 includes a first reservoir, indicated generally as 116, provided with a supply of a coating composition, indicated generally as 120. A first take up roll, indicated generally as 124 which may rotate in a counterclockwise direction, as indicated by curved arrow 128, picks up an amount of the coating composition from supply 120. This amount of coating composition that is picked up by rotating roll 124 may then be transferred to a first applicator roll, indicated generally as 132, which rotates in the opposite and clockwise direction, as indicated by curved arrow 136. (The positioning of first take up roll 124 shown in FIG. 1 is simply illustrative and roll 124 may be positioned in various ways relative to first applicator roll 132 such that the coating composition is transferred to the surface of applicator roll 132.) The amount of coating composition that is transferred to first applicator roll 132 may be controlled by metering rod 144 which spreads the transferred composition on the surface of applicator roll 132, thus providing relatively uniform and consistent thickness of a first coating, indicated as 148, when applied onto the first surface 108 of substrate 104 by applicator roll 232.

As shown in FIG. 1, size press 100 may also be provided with a second assembly indicated generally as 152, for applying the coating composition to surface 112. Assembly 152 includes a second reservoir indicated generally as 156, provided with a second supply of a coating composition, indicated generally as 160. A second take up roll, indicated generally as 164 which may rotate in a clockwise direction, as indicated by curved arrow 168, picks up an amount of the coating composition from supply 160. This amount of coating composition that is picked up by rotating roll 164 may then be transferred to second take up roll, indicated generally as 172, which rotates in the opposite and counterclockwise direction, as indicated by curved arrow 176. As indicated in FIG. 1 by the dashed-line box and arrow 176, second take up roll 164 may be positioned in various ways relative to second applicator roll 172 such that the coating composition is transferred to the surface of applicator roll 172. The amount of coating composition that is transferred to second applicator roll 172 may be controlled by a second metering rod 184 which spreads the transferred composition on the surface of applicator roll 172, thus providing relatively uniform and consistent thickness of the second coating, indicated as 188, when applied onto the second surface 112 of substrate 104 by applicator roll 172.

Figure 2:
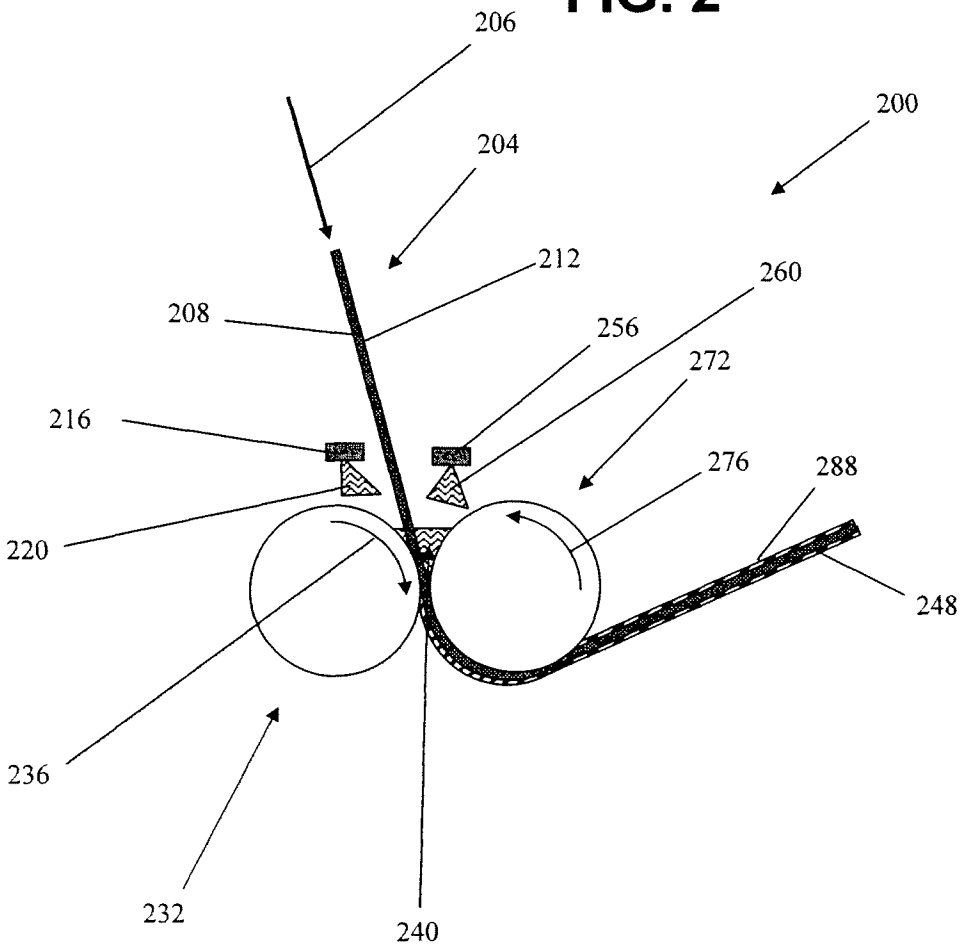
FIG. 2 is a schematic diagram illustrating an embodiment of a method for treating one or both surfaces of a paper substrate with a coating composition using a horizontal flooded nip size press.

Referring to FIG. 2, another embodiment of a system for carrying out an embodiment of the method of the present invention is illustrated which may be in the form of, for example, a horizontal flooded nip size press indicated generally as 200. Horizontal size press 300 may be used to coat a paper web, indicated generally as 204, with a coating composition (e.g., as described in FIG. 1 above). Web 204 moves in the direction indicated by arrow 206, and has a pair of opposed sides or surfaces, indicated, respectively, as 208 and 212.

Horizontal size press 200 includes a first source of coating composition, indicated generally as nozzle 216, which is sprays a stream of the coating composition, indicated by 220, generally downwardly towards the surface of a first transfer roll, indicated as 232, which rotates in a clockwise direction, as indicated by curved arrow 236. A flooded pond or puddle, indicated generally as 240, is created at the nip between first transfer roll 232 and second transfer roll 272 due to a bar or dam (not shown) positioned at below the nip. Transfer roll 232 transfers a relatively uniform and consistent thickness of a first coating of the coating composition, indicated as 248, onto the first surface 208 of web 204.

A second source of coating composition, indicated generally as nozzle 256, which is sprays a stream of the coating composition, indicated by 260, generally downwardly towards the surface of a second transfer roll, indicated as 272, which rotates in a counterclockwise direction, as indicated by curved arrow 276. Transfer roll 272 transfers a relatively uniform and consistent thickness of a second coating of the coating composition, indicated as 288, onto the second surface 212 of web 204.

Figure 3:
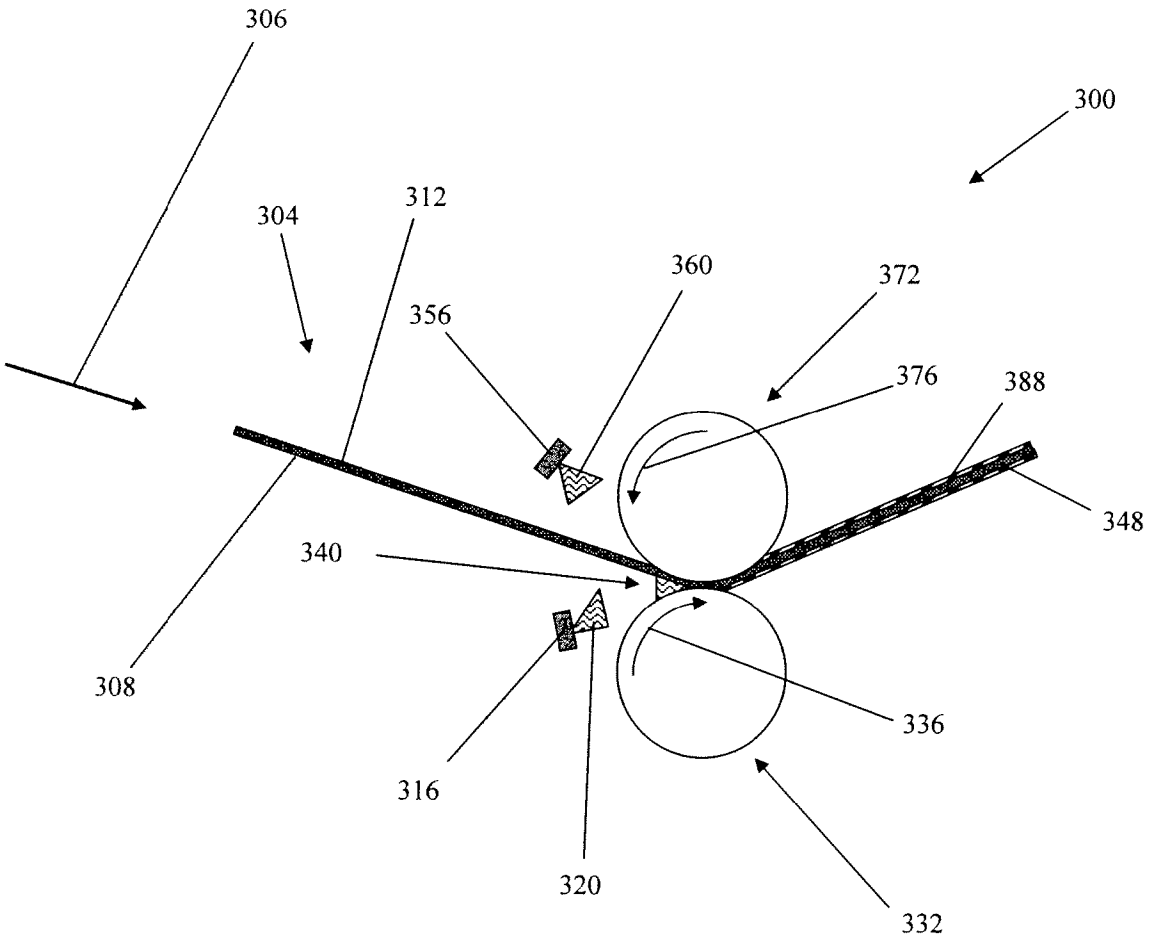
FIG. 3 is a schematic diagram illustrating an embodiment of a method for treating one or both surfaces of a paper substrate with a coating composition using a vertical flooded nip size press.

Referring to FIG. 3, another embodiment of a system for carrying out an embodiment of the method of the present invention is illustrated which may be in the form of, for example, a vertical flooded nip size press indicated generally as 300. Vertical size press 300 may be used to coat a paper web, indicated generally as 304, with a coating composition (e.g., as described in FIG. 1 above). Web 304 moves in the direction indicated by arrow 306, and has a pair of opposed sides or surfaces, indicated, respectively, as 308 and 312.

Vertical size press 300 includes a first source of coating composition, indicated generally as nozzle 316, which is sprays a stream of the coating composition, indicated by 320, generally upwardly and towards the surface of a first lower transfer roll of the roll stack, indicated as 332, which rotates in a clockwise direction, as indicated by curved arrow 336. A smaller flooded pond or puddle, indicated generally as 340, (compared to the pond or puddle 340 of horizontal size press 300) is created at the nip between lower first transfer roll 332 and second upper transfer roll 372 due to a bar or dam (not shown) positioned to right of the nip. Transfer roll 332 transfers a relatively uniform and consistent thickness of a first coating of the coating composition, indicated as 348, onto the lower first surface 308 of web 304.

A second source of coating composition, indicated generally as nozzle 356, sprays a stream of the coating composition, indicated by 360, generally downwardly and towards the surface of a second upper transfer roll, indicated as 372, which rotates in a counterclockwise direction, as indicated by curved arrow 376. Transfer roll 372 transfers a relatively uniform and consistent thickness of a second coating of the coating composition, indicated as 388, onto the upper second surface 312 of web 304.

EXAMPLES

Illustrative embodiments of coated paper substrates and methods for preparing same are shown below:

Example 1

The coating compositions listed in Table 1 (in terms of dry parts for each ingredient, total solids of each composition, coating weight per side, etc.) are prepared, and are coated onto both sides of a 38 lb/3300 base paper:

TABLE 1

| Chemical | Trade Name | Run 1-1 | Run 1-2 | Run 1-3 | Run 1-4 |
|---|---|---|---|---|---|
| Larger, porous GCC pigment | Omyajet, 36% | | | | 100 |
| Larger, porous GCC pigment | Omyajet, 34% | 55 | 55 | 55 | |
| Smaller GCC pigment | Hydrocarb 90, 76% | 45 | | | |
| Smaller GCC pigment | Setacarb, 76% | | 45 | 45 | |
| Polyvinyl alcohol binder | Celvol 203S | 4 | 4 | 4 | |
| Starch binder | Penford 290 | 6 | 6 | 6 | 50 |
| PolyDADMAC dye fixative | Nalkat 2020 | 2 | 2 | 2 | |
| Calcium stearate lubricant | Devflo 50C, 50% | 1 | 1 | 1 | 1 |
| Multivalent metal drying salt | $CaCl_2$, 32% | 2 | 2 | 2 | |
| Polyacrylate thickener | Rheocarb 120 | 0.1 | | | 0.5 |
| Total Parts | | 115.1 | 115 | 115 | 151.5 |
| Solids, % | | 42 | 42 | 42 | 30 |
| Coat weight (gsm/side) | | 9 | 9 | 5 | 5 |

The ingredients for each coating composition shown in Table 1 above are added in the order listed into a high shear mixer. The paper web is coated using a blade coater at a speed of about 800 meters/min. The paper is then cut into 8.5 in.×11 in. sheets and printed on an Epson C88+ desktop printer. The test pattern consists of solid blocks of black, cyan, magenta, yellow, blue, red, and green. An unprinted area is used to measure white. This test pattern (using an EPSON C88+ printer, Plain Paper setting) is printed in three print modes: draft, text, and image. The density of the black blocks are measured using an X-Rite model 528 spectrodensitometer as described in the paragraph above relating to the term "print density"), and are recorded in Table 2:

TABLE 2

| Sample | Draft | Text | Image |
|---|---|---|---|
| Run 1-1 | 0.53 | 1.38 | 1.46 |
| Run 1-2 | 0.50 | 1.42 | 1.44 |
| Run 1-3 | 0.62 | 1.43 | 1.45 |
| Run 1-4 | 0.92 | 1.42 | 1.46 |
| Base Paper | 0.81 | 1.29 | 1.32 |
| Ink Laydown (gsm) | 2.92 | 8.95 | 10.32 |

Figure 4:
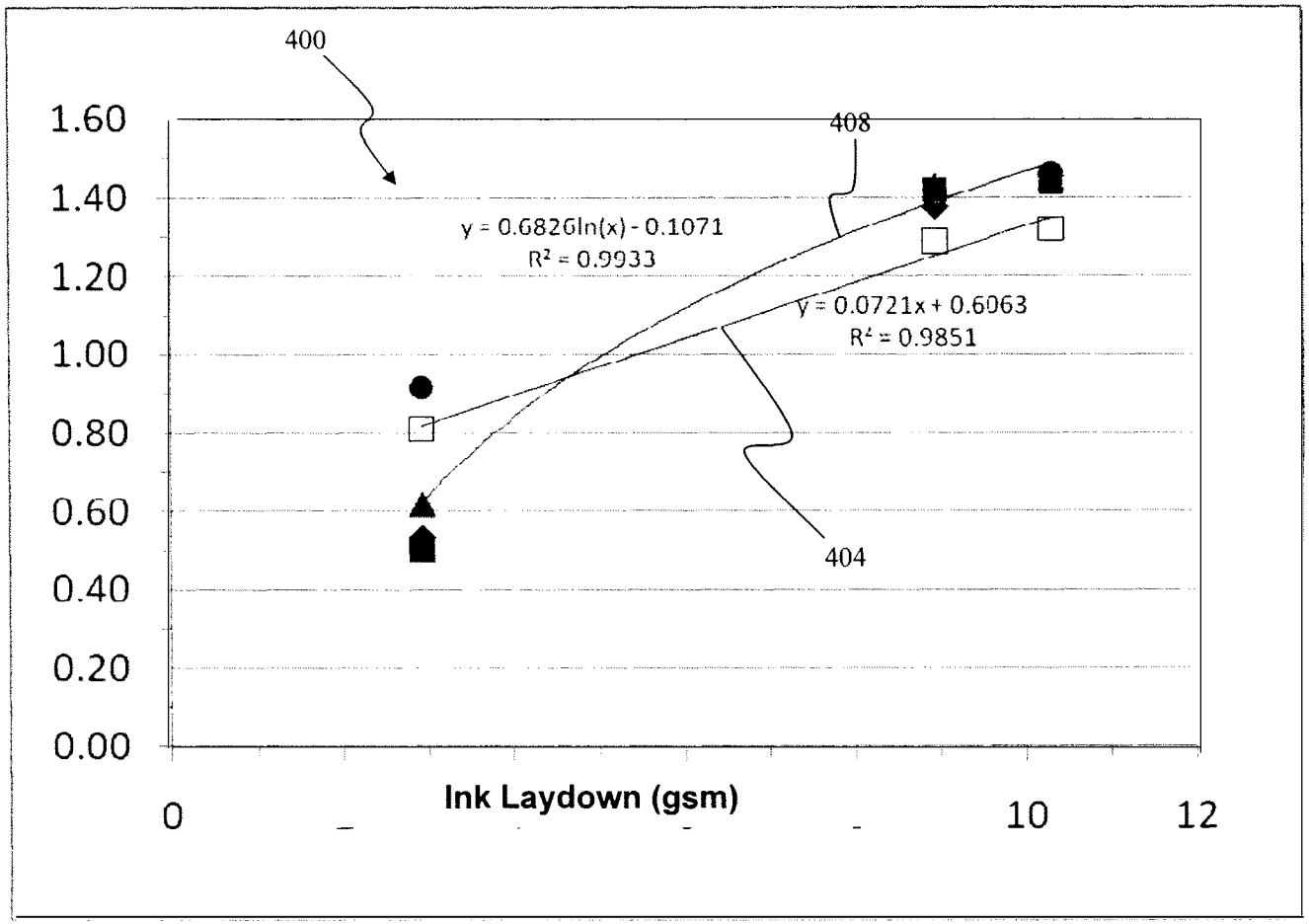
FIG. 4 shows graphical plots of black print density (OD) values versus ink laydown values for four coatings, relative to values for the base paper, and including a linear plot of the base paper values, as well as a log plot of values for one of the coatings.

The ink laydown is measured by weighing a sheet of paper before and after printing a 7.5 in.×9 in. solid black block, and calculating the amount of ink printed in units of grams per square meter (gsm). This ink laydown is measured three times, and averaged to obtain the values shown in Table 2. FIG. 4 shows graphical plots, indicated generally as 400, of black print density (OD) values versus ink laydown values from Table 2 for Run 1-1 (solid diamonds), Run 1-2 (solid squares), Run 1-3 (solid triangles), and Run 1-4 (solid circles) relative to the Base Paper (open squares). Straight line 404 represents a linear plot of Base Paper values, while curved line 408 represents a log plot of the Run 1-3 values. FIG. 4 shows that the four papers give similar black density values when printed at the normal (text) and best (image) print modes. However, when printed in draft mode, which has a much lower ink laydown value, Run 1-4 gives a much higher black print density (OD) because the compositions of Run 1-1 through Run 1-3 have a higher 10:1 pigment:binder ratio, while the composition of Run 4 has a lower pigment to binder ratio of 2:1. The coatings of Run 1-1 and Run 1-2 are also about twice as thick as the coating for Run 1-4. Both of these factors mean that the coatings of Run 1-1 and Run 1-2 have much higher ink capacities than the ink capacity for the coating of Run 1-4. Based on Scanning Electron Microscope (SEM) photos, the ink is distributed throughout the coating, but not much of the coating into the paper which is coated. Therefore, the pores are mostly filled in the coating of Run 1-4, even at lower ink laydown, whereas the coatings of Runs 1-1 and 1-2 are mostly unfilled at lower ink laydowns. The unfilled pores contribute to light scattering, which tends to make the print density appear lower (more "washed out") compared to the more filled pores of the coated paper of Run 1-4. However, at higher ink laydowns (i.e., when all the pores are filled or nearly full throughout the coating thickness), the four coated papers have similar print densities. Conversely, a paper that is optimized for printing at normal print settings will not necessarily print well at low ink laydowns.

Example 2

Four coating compositions are made in the lab as shown in Table 3:

TABLE 3

| Chemical | Trade Name | Coating 2-1 | Coating 2-2 | Coating 2-3 | Coating 2-4 |
|---|---|---|---|---|---|
| Larger, porous GCC pigment | Omyajet, 36% | 100 | 100 | 100 | 100 |
| Starch binder | Ethylex 2065 | 200 | 100 | 50 | 25 |
| Total Pacts | | 300 | 200 | 150 | 125 |
| Solids, % | | 30 | 30 | 30 | 30 |

All four coatings shown in Table 3 contain larger porous GCC pigments with different pigment/binder ratios of the ethylated starch binder. Each 100 g coating is hand mixed using a spatula until homogeneous in appearance. Meyer rods are then used to create coated paper samples of different thicknesses for each coating. The samples are dried after coating for about 1 minute in an air convection oven set at a temperature of about 110° C. The base paper used has a basis weight of about 38 lbs/3300 $ft^2$. and no surface sizing at the size press. The rod sizes used and coat weights achieved are listed for each sample in Table 4 below. The samples are then printed with an Epson TM-C600 ink jet printer, plain paper setting, draft mode to compare the print densities and dry time. The test pattern consists of solid blocks of black, cyan, magenta, and yellow. The print density of each solid block is measured using an X-Rite model 528 spectrodensitometer as described in the paragraph above resulting to the term "print density"), and are recorded in Table 4:

TABLE 4

| P/B Ratio | Coating | Rod Size | Coat Wt (gsm) | Dry time (s) | Print Density (OD) Black | Cyan | Magenta | Yellow |
|---|---|---|---|---|---|---|---|---|
| 1:2 | 2-1 | #3 | 2.0 | 30 | 0.77 | 0.68 | 0.72 | 0.69 |
| | | #7 | 4.7 | 35 | 0.77 | 0.67 | 0.69 | 0.69 |
| | | #11 | 7.4 | 30 | 0.80 | 0.67 | 0.74 | 0.72 |
| 1:1 | 2-2 | #3 | 2.2 | 20 | 0.87 | 0.76 | 0.75 | 0.72 |
| | | #7 | 5.2 | 25 | 0.86 | 0.76 | 0.73 | 0.73 |
| | | #11 | 8.2 | 20 | 0.84 | 0.75 | 0.72 | 0.72 |
| 2:1 | 2-3 | #3 | 2.5 | 10 | 0.88 | 0.80 | 0.75 | 0.72 |
| | | #7 | 5.7 | 10 | 0.90 | 0.81 | 0.75 | 0.71 |
| | | #11 | 9.0 | 15 | 0.90 | 0.80 | 0.75 | 0.71 |
| 4:1 | 2-4 | #3 | 2.7 | 5 | 0.80 | 0.83 | 0.77 | 0.70 |
| | | #7 | 6.3 | 5 | 0.77 | 0.84 | 0.77 | 0.70 |
| | | #11 | 9.9 | 5 | 0.76 | 0.77 | 0.73 | 0.66 |

The results in Table 4 show that dry time depends strongly on the pigment/binder ratio used. For example, lower binder amounts help to create a more porous coating structure, which leads to better dry times.

Example 3

Four coating compositions are made in the lab as shown in Table 5:

TABLE 5

| Chemical | Trade Name | Run 3-1 | Run 3-2 | Run 3-3 | Run 3-4 |
|---|---|---|---|---|---|
| Larger, porous GCC pigment | Omyajet, 36% | 80 | 90 | | |
| absorptive plastic pigment | DOW | | 10 | | |
| Smaller GCC pigment | Aerodisp W7330N | 20 | | | |
| Smaller GCC pigment | Omya CoverCarb 85 | | | 100 | 100 |
| Starch binder | Ethylex 2040 | 25 | 25 | | |
| Latex binder | DOW Latex 31301 | 12.5 | 12.5 | | |
| Polyvinyl Alcohol binder | Celvol 325 | | | 10 | 7 |
| PolyDADMAC dye fixative | Nalco 2020 | 10 | | | |
| Glyoxal Crosslinker | Cartabond TSI | 4 | 4 | 4 | 4 |
| Total Parts | | 151.5 | 141.5 | 114 | 111 |
| Solids, % | | 30 | 30 | 30 | 30 |

The first two coatings (for Runs 3-1 and 3-2) are two different coating compositions according to embodiments of the present invention which exhibit superior print quality while achieving excellent dry time and wet rub resistance. The second two coatings (for Runs 3-3 and 3-4) are for comparative purposes. Each 100 g coating is hand mixed using a spatula until homogeneous in appearance. Meyer rods are then used to create coated paper samples of the thicknesses shown for each coating. The samples are dried after coating for about 1 minute in an air convection oven set at a temperature of about 110° C. The base paper used has a basis weight of about 38 lbs/3300 $ft^2$ and no surface sizing at the size press. The rod sizes used and coat weights achieved are listed for each sample in Table 6 below. The samples are then printed with an Epson TM-C600 ink jet printer, plain paper setting, draft mode to compare the print densities and dry time. The test pattern consists of solid blocks of black, cyan, magenta, and yellow. The print density of each solid block was measured using an X-Rite model 528 spectrodensitometer as described in the paragraph above relating to the term "print density"), and are recorded in Table 6:

TABLE 6

| P/B Ratio | Coating | Rod Size | Coat Wt (gsm) | Dry time (s) | Wet Rub | Print Density (OD) Black | Cyan | Magenta | Yellow |
|---|---|---|---|---|---|---|---|---|---|
| 2.7:1 | Run 3-1 | #7 | 5.0 | 0 | Good | 0.79 | 0.86 | 0.78 | 0.70 |
| 2.7:1 | Run 3-2 | #9 | 7.5 | 0 | Good | 0.81 | 0.90 | 0.82 | 0.73 |
| 10:1 | Run 3-3 | #8 | 9.0 | 10 | Poor | 1.04 | 1.01 | 0.92 | 0.79 |
| 7:1 | Run 3-4 | #14 | 15.0 | 0 | Poor | 0.93 | 0.84 | 0.90 | 0.75 |

The results in Table 6 show that the first two coating samples (Runs 3-1 and 3-2) made according to embodiments of the present invention exhibit good print density for all colors measured, as well as excellent dry time and good wet rub resistance. On the other hand, the coating samples for Runs 3-3 and 3-4, which did not contain any larger porous GCC pigment particles but only contained smaller GCC pigment particles, both exhibit poor wet rub resistance. Because of the lack of larger, porous GCC pigment particles, the coatings from the samples for Runs 3-3 and 3-4 are less absorbent, and thus the coat weights may need to be increased to achieve good dry times. Even with a 9 gsm coat weight, Run 3-3 sample still has a poor dry time of 10 seconds. Run 3-4 with a 15 gsm coat weight does achieve a good dry time, but still has poor wet rub resistance.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. An article comprising:

a paper substrate having a first surface and a second surface, wherein the paper substrate has a Hercules Sizing Test (HST) value of up to about 50 seconds as measured using the procedure of TAPPI standard method T-530 pm-89; and a water-swellable substrate coating on at least one of the first and second surfaces which has a thickness of less than about 10 microns and provides an ink-receptive porous surface, wherein the substrate coating comprises:

a water-swellable coating pigment binder matrix, wherein the binder matrix comprises a water-soluble polymer binder and a polymer latex binder in a weight ratio of at least about 1:1 and which have been crosslinked; and an amount of a coating pigment sufficient to impart a Parker Print Smoothness value as measured by TAPPI test method T-555 om-99 of at least about 4 to the at least one of the first and second surfaces which is dispersed in the binder matrix in a weight ratio of coating pigment to binder matrix of at least about 2:1, and wherein the coating pigment comprises:

larger porous coating pigment particles having a particle size above about 1 micron and an effective pore volume of at least about 0.1 cc/gm, and smaller coating pigment particles having a particle size of about 1 micron or less;

wherein the larger porous coating pigment particles to smaller coating pigment particles are in a weight ratio of least about 0.2:1.

2. The article of claim 1, wherein the substrate coating is on both the first and second surfaces.

3. The article of claim 1, wherein the weight ratio of coating pigment to binder matrix is in the range of about 2:1 to about 10:1.

4. The article of claim 3, wherein the weight ratio of coating pigment to binder matrix is in the range of about 3:1 to about 5:1.

5. The article of claim 1, wherein the larger porous coating pigment particles comprise one or more of: ground calcium carbonate pigment particles, precipitated calcium carbonate pigment particles, absorbent plastic pigment particles, clay pigment particles, kaolin pigment particles, calcined clay pigment particles, talc pigment particles, titanium dioxide pigment particles, barium sulfate pigment particles, silica pigment particles, or zeolite pigment particles.

6. The article of claim 5, wherein the larger porous coating pigment particles comprise one or more of: ground calcium carbonate pigment particles or precipitated calcium carbonate pigment particles.

7. The article of claim 5, wherein the larger porous coating pigment particles have an effective pore volume of at least about 0.2 cc/gm.

8. The article of claim 7, wherein the larger porous coating pigment particles have an effective pore volume of at least about 0.3 cc/gm.

9. The article of claim 1, wherein the smaller coating pigment particles comprise one or more of: fumed silica pigment particles, alumina pigment particles, ground calcium carbonate pigment particles, precipitated calcium carbonate pigment particles, clay pigment particles, kaolin pigment particles, calcined clay pigment particles, bentonite clay pigment particles, talc pigment particles, titanium dioxide pigment particles, barium sulfate pigment particles, silica pigment particles, or zeolite pigment particles.

10. The article of claim 9, wherein the smaller coating pigment particles comprise fumed silica pigment particles.

11. The article of claim 1, wherein the weight ratio of larger porous coating pigment particles to smaller coating pigment particles is at least about 1:1.

12. The article of claim 11, wherein the weight ratio of larger porous coating pigment particles to smaller coating pigment particles is at least about 3:1.

13. The article of claim 1, wherein the weight ratio of water-soluble polymer binder to polymer latex binder is in the range of from about 1:1 to about 10:1.

14. The article of claim 13, wherein the weight ratio of water-soluble polymer binder to polymer latex binder is in the range of from about 1.5:1 to about 2.5:1.

15. The article of claim 1, wherein the water-soluble polymer binder comprises one or more of: starch binders, cellulosic binders, polyvinyl alcohol binders, polyacrylic acid binders, polymethacrylic acid binders, polyvinylamine binders, polyacrylamide binders, polyether binders, sulfonated polystyrene binders, or carboxylated polystyrene binders.

16. The article of claim 15, wherein the water-soluble polymer binder comprises a starch binder.

17. The article of claim 1, wherein the polymer latex binder comprises one or more of: styrene butadiene rubber latexes, acrylic polymer latexes, polyvinyl acetate latexes, styrene acrylic copolymer latexes, polyurethane latexes, starch/acrylic copolymer latexes, starch/styrene acrylic copolymer latexes, polyvinyl alcohol (PVOH)/styrene acrylic copolymer latexes, or PVOH/acrylic copolymer latexes.

18. The article of claim 17, wherein the polymer latex binder comprises a styrene-acrylic latex binder.

19. The article of claim 18, wherein the water-soluble polymer binder comprises an ethylated starch binder, and wherein the styrene-acrylic latex binder and the ethylated starch binder are crosslinked with glyoxal.

20. The article of claim 1, wherein the substrate coating has a thickness in the range of from about 3 to about 8 microns.

21. The article of claim 1, wherein the paper substrate has an HST value of up to about 40 seconds.

22. A method comprising the following steps:

(a) providing a paper substrate having a first surface and a second surface, wherein the paper substrate has a Hercules Sizing Test (HST) value of up to about 50 seconds as measured using the procedure of TAPPI standard method T-530 pm-89; and (b) treating at least one of the first and second surfaces with a water-swellable substrate coating to provide a printable substrate, wherein the substrate coating has a thickness of less than about 10 microns and provides an ink-receptive porous surface, and wherein the substrate coating comprises:

a water-swellable coating pigment binder matrix, wherein the binder matrix comprises a water-soluble polymer binder and a polymer latex binder in a weight ratio of at least about 1:1 and which have been crosslinked; and an amount of a coating pigment sufficient to impart a Parker Print Smoothness value as measured by TAPPi test method T-555 om-99 of at least about 4 to the at least one of the first and second surfaces, wherein the coating pigment is dispersed in the binder matrix in a coating pigment to binder matrix weight ratio of at least about 2:1, and wherein the coating pigment comprises:

larger porous coating pigment particles having a particle size above about 1 micron and an effective pore volume of at least about 0.1 cc/gm; and smaller coating pigment particles having a particle size of about 1 micron or less;

wherein the larger porous coating pigment particles to smaller coating pigment particles are in a weight ratio of at least about 0.2:1.

23. The method of claim 22, wherein step (b) comprises treating both the first and second surfaces with the substrate coating.

24. The method of claim 22, wherein the weight ratio of coating pigment to binder matrix of the substrate coating of step (b) is in the range of about 2:1 to about 10:1.

25. The method of claim 24, wherein the weight ratio of coating pigment to binder matrix of the substrate coating of step (b) is in the range of about 3:1 to about 5:1.

26. The method of claim 22 wherein the larger porous coating pigment particles of the substrate coating of step (b) comprise one or more of: ground calcium carbonate particles, precipitated calcium carbonate particles, absorbent plastic pigment particles, clay pigment particles, kaolin pigment particles, calcined clay pigment particles, talc pigment particles, titanium dioxide pigment particles, barium sulfate pigment particles, silica pigment particles, or zeolite pigment particles.

27. The method of claim 26, wherein the larger porous coating pigment particles of the substrate coating of step (b) comprise one or more of: ground calcium carbonate pigment particles or precipitated calcium carbonate pigment particles.

28. The method of claim 26 wherein the larger porous coating pigment particles of the substrate coating of step (b) have an effective pore volume of at least about 0.2 cc/gm.

29. The method of claim 28 wherein the larger porous coating pigment particles of the substrate coating of step (b) have an effective pore volume of at least about 0.3 cc/gm.

30. The method of claim 22, wherein the smaller coating pigment particles of the substrate coating of step (b) comprise one or more of: fumed silica pigment particles, alumina pigment particles, ground calcium carbonate pigment particles, precipitated calcium carbonate pigment particles, clay pigment particles, kaolin pigment particles, calcined clay pigment particles, bentonite clay pigment particles, talc pigment particles, titanium dioxide pigment particles, barium sulfate pigment particles, or silica pigment particles.

31. The method of claim 30, wherein the smaller coating pigment particles of the substrate coating of step (b) comprise fumed silica pigment particles.

32. The method of claim 31, wherein the weight ratio of larger porous coating pigment particles to smaller coating pigment particles of the substrate coating of step (b) is at least about 1:1.

33. The method of claim 32, wherein the weight ratio of larger porous coating pigment particles to smaller coating pigment particles of the substrate coating of step (b) is at least about 3:1.

34. The method of claim 22, wherein the weight ratio of water-soluble polymer binder to polymer latex binder of the substrate coating of step (b) is in the range of from about 1:1 to about 10:1.

35. The method of claim 34, wherein the weight ratio of water-soluble polymer binder to polymer latex binder of the substrate coating of step (b) is in the range of from about 1.5:1 to about 2.5:1.

36. The method of claim 22, wherein the water-soluble polymer binder of the substrate coating of step (b) comprises one or more of: starch binders, cellulosic binders, polyvinyl alcohol binders, polyacrylic acid binders, polymethacrylic acid binders, polyvinylamine binders, polyacrylamide binders, polyether binders, sulfonated polystyrene binders, or carboxylated polystyrene binders.

37. The method of claim 36, wherein the water-soluble polymer binder of the substrate coating of step (b) comprises a starch binder.

38. The method of claim 22, wherein the polymer latex binder of the substrate coating of step (b) comprises one or more of: styrene butadiene rubber latexes, acrylic polymer latexes, polyvinyl acetate latexes, styrene acrylic copolymer latexes, polyurethane latexes, starch/acrylic copolymer latexes, starch/styrene acrylic copolymer latexes, polyvinyl alcohol (PVOH)/styrene acrylic copolymer latexes, PVOH/acrylic copolymer latexes, or epoxy latexes.

39. The method of claim 38, wherein the polymer latex binder of the substrate coating of step (b) comprises a styrene-acrylic latex binder.

40. The method of claim 39, wherein the water-soluble polymer binder of the substrate coating of step (b) comprises an ethylated starch binder, and wherein the styrene-acrylic latex binder and the ethylated starch binder are crosslinked with glyoxal.

41. The method of claim 22, wherein the substrate coating of step (b) has a thickness in the range of from about 3 to about 8 microns.

* * * * *